United States Patent [19]

Moffat et al.

[11] Patent Number: 4,937,167

[45] Date of Patent: Jun. 26, 1990

[54] PROCESS FOR CONTROLLING THE ELECTRICAL CHARACTERISTICS OF TONERS

[75] Inventors: Karen A. Moffat, Brantford; Marcel P. Breton, Mississauga; Trevor I. Martin, Burlington; Paul J. Gerroir, Toronto, all of Canada

[73] Assignee: Xerox Corporation, Stamford, Conn.

[21] Appl. No.: 312,848

[22] Filed: Feb. 21, 1989

[51] Int. Cl.[5] ..... G03G 9/08

[52] U.S. Cl. ..... 430/137; 430/138; 430/109; 430/110

[58] Field of Search ..... 430/137, 138

[56] References Cited

U.S. PATENT DOCUMENTS

| | | | |
|---|---|---|---|
| 4,000,087 | 12/1976 | Maalouf | 252/316 |
| 4,070,186 | 1/1978 | Gibson et al. . | |
| 4,070,296 | 1/1978 | Gibson et al. . | |
| 4,134,760 | 1/1979 | Gibson et al. . | |
| 4,227,011 | 2/1988 | Mahabadi et al. | 430/138 |
| 4,254,201 | 3/1981 | Sawai et al. | 430/111 |
| 4,307,169 | 12/1981 | Matkan et al. | 430/111 |
| 4,520,091 | 5/1985 | Kakimi et al. | 430/110 |
| 4,565,764 | 1/1986 | Nakahara et al. | 430/111 |
| 4,613,559 | 9/1986 | Ober et al. | 430/137 |
| 4,628,019 | 12/1986 | Suematsu et al. | 430/106.6 |
| 4,702,988 | 10/1987 | Fukumoto et al. | 430/137 |
| 4,708,924 | 11/1987 | Nagai et al. | 430/138 |
| 4,725,522 | 2/1988 | Breton et al. | 430/138 |
| 4,766,051 | 8/1988 | Breton et al. | 430/138 |

*Primary Examiner*—Roland E. Martin

*Attorney, Agent, or Firm*—Judith L. Byorick

[57] ABSTRACT

Disclosed is a process for controlling the electrical characteristics of colored toner particles. The process comprises preparing a first core material comprising first pigment particles, core monomers, a free radical initiator, and optional polymer components; preparing a second core material which comprises second pigment particles, core monomers, a free radical initiator, and optional polymer components, said second pigment particles being of a different color from that of the first pigment particles; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby producing two encapsulated heat fusible toner compositions of different colors with similar triboelectric charging characteristics.

45 Claims, 2 Drawing Sheets

Tribo Values of Melt Blended and Encapsulated Color Toners

PROCESS FOR CONTROLLING THE ELECTRICAL CHARACTERISTICS OF TONERS

BACKGROUND OF THE INVENTION

The present invention is directed to a process for controlling the triboelectric properties of toners. More specifically, the present invention is directed to a process for controlling the triboelectric properties of toner particles by preparing a polymeric core material containing the pigment colorant and encapsulating the core material within a polymeric shell.

Toners suitable for use in electrophotographic copiers and printers may have a wide variety of colors, such as black, red, green, blue, brown, yellow, purple, silver and gold. When it is desired to highlight certain features of a document, one or more colored toners are typically used in conjunction with a black toner to provide an image in two or more colors. Full color images can also be produced by developing images with cyan, magenta, yellow, and black toners. Generally, it is advantageous for such toners to exhibit low melting temperatures to enable low energy fusing of the developed images to substrates at lower temperatures. It is also often advantageous for such toners to possess mean particle diameters of less than about 10 microns to enable images of high resolution, low image noise and high color fidelity. Further, it is generally desirable for these small diameter toners to have very narrow size distributions, preferably in the range of a geometric size dispersity (GSD) of 1.2 to 1.3, to avoid difficulties in electrophotographic development and transfer associated with oversize toner particles and extremely fine toner particles.

It is also an advantage to be able to control selectively the triboelectric charging level of different color toners, permitting them to attain the same equilibrium triboelectric charging level against selected carriers in two component development systems. It is also desirable to be able to control the rate of charging of toner, freshly added to a toner depleted development package, such that it rapidly achieves the same sign and level of triboelectric charge possessed by the equilibrated toner.

When manufacturing color toners by conventional techniques, which include melt-blending the colored pigments into desired resins and employing Banbury mixers or screw extruders, several problems are encountered in the preparation of colored toners with controlled triboelectric properties. First, the quality of the pigment dispersion greatly influences the triboelectric position of the toner. While pigment dispersion agents can improve the pigment dispersion and thereby improve the transparency of the toner, these dispersants can adversely affect the triboelectric properties of the toner and the triboelectric stability at different relative humidities and can also interfere with the melt rheological properties and fusing properties of the toner particles.

In addition, when attempting to prepare very small diameter toners with narrow size distributions by micronization and classification of melt-blended composites, there is generally a significant loss of yield of toner due to creation of fines, which generally are toner particles with an average particle diameter of less than 5 microns. This problem is aggravated when attempting to prepare low melting/low fusing temperature compositions, since the jetting yield is reduced for soft, rubbery materials. Although this problem can be overcome to some extent by cryogenic jetting, using cold air, it is only at the expense of slower jetting rates and increased costs resulting from the need to employ cooled air.

Further, it is frequently observed that different colored pigments, as a result of their complex and unique molecular structures, have a profound effect on the triboelectric properties of toners prepared by melt blending the pigments with preferred resins, followed by micronization and classification. Thus, certain pigments can dominate the triboelectric properties to the extent that two different pigments, such as Lithol Scarlet D3700 (BASF) and PV Fast Blue B2G01 (American Hoechst), when melt-blended into an identical resin at identical pigment loadings and formulated into toners of equivalent particle diameter and particle size distribution, will exhibit dramatically different triboelectric properties. For example, a toner composition comprising from about 5 percent to about 8 percent by weight of Lithol Scarlet pigment in from about 92 percent to about 95 percent by weight of a styrene-butadiene copolymer resin comprising about 87 percent by weight of styrene and about 13 percent by weight of butadiene is typically characterized by a triboelectric charge of from about −30 to −40 microcoulombs per gram. In contrast, a toner composition comprising the same amount of PV Fast Blue pigment in the same styrene-butadiene resin is typically characterized by a triboelectric charge of about +50 microcoulombs per gram. This pigment domination effect may be overcome to some extent through the use of added charge control agents, either negative or positive, but the effect is generally not rectified completely and is very difficult to control. It is generally advantageous for optimum image development to be able to achieve identical levels of triboelectric charging, employing the same resin system and the same carrier, for toners prepared from different colored pigments. This result would allow for simpler, more reliable, and reproducible developer subsystems and fuser subsystems and would result in improved copy quality.

The process of the present invention provides the aforementioned advantages by providing a process for controlling the triboelectric properties of colored toner particles which comprises preparing a first core material comprising first pigment particles, core monomers, a free radical initiator, and optional polymer components; preparing a second core material which comprises second pigment particles, core monomers, a free radical initiator, and optional polymer components, said second pigment particles being of a different color from that of the first pigment particles; dispersing the first and second core materials into an aqueous phase; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby producing two encapsulated heat fusible toner compositions of different colors with similar triboelectric charging characteristics.

Encapsulating toners are known. For example, U.S. Pat. No. 4,565,764 discloses a pressure fixable microcapsule toner having a colored core material coated successively with a first resin wall and a second resin wall. The first resin wall has affinity to both the core material and the second resin wall. This patent teaches that the first resin wall may be of a material that becomes charged to a polarity opposite to that of the second resin wall and the core material.

Additionally, U.S. Pat. No. 4,520,091 discloses a pressure fixable encapsulated electrostatographic toner material. The core comprises a colorant, a polymer, a solvent capable of dissolving the polymer or causing the polymer to swell, and an organic liquid incapable of dissolving the polymer or causing the polymer to swell, while the shell may consist of a polyamide resin. Preparation of the toner material is completed by interfacial polymerization.

Another patent, U.S. Pat. No. 4,708,924, discloses a pressure fixable microcapsule type toner composed of a core material and an outer wall covering over the core material. The core material contains at least a combination of a substance having a glass transition point within the range of −90° C. to 5° C. with a substance having a softening point within the range of 25° C. to 180° C. This toner composition may comprise substances such as polystyrene and poly(n-butyl)methacrylate and their copolymers.

Further, U.S. Pat. No. 4,254,201 discloses a pressure sensitive adhesive toner consisting essentially of porous aggregates. Each aggregate consists essentially of a cluster of a multiplicity of individual granules of pressure sensitive adhesive substance, each granule being encapsulated by a coating film of a film-forming material. Particles of an inorganic or organic pigment and/or a magnetic substance are contained within the aggregate in the interstices between the granules and deposited on the surfaces of the encapsulated granules. The adhesive substance is selected from a copolymer of at least one monomer and as many as three other monomers.

In addition, U.S. Pat. No. 4,702,988 discloses a process for producing toner. A monomer composition and a colorant are dispersed in a liquid dispersion medium in the presence of a solid fine powdery dispersion stabilizer. The liquid is pressurized and then ejected into a low pressure section to form particles of monomer composition. These particles are then subjected to suspension polymerization to produce toner particles.

Further, U.S. Pat. No. 4,766,051 discloses colored cold pressure fixable toner compositions with hard shells obtained by hydrolysis and interfacial polymerization. The core consists of the organic soluble shell component or components, a core polymer, a low boiling point solvent into which the core polymer is soluble and a dispersed newsprint ink concentrate. The newsprint inks are inexpensive rubber based printing inks consisting of cyan, magenta, yellow, red, and mixtures thereof excluding carbon black and magnetite.

U.S. Pat. No. 4,727,011 discloses a process for preparing encapsulated toner compositions which comprises mixing, in the absence of a solvent, a core monomer, an initiator, pigment particles, a first shell monomer, stabilizer, and water; thereafter adding a second shell monomer, thereby enabling an interfacial polymerization reaction between the first and second shell monomers; and subsequently effecting a free radical polymerization of the core monomer. The disclosure of this patent is totally incorporated herein by reference.

Further, U.S. Pat. No. 4,766,051 discloses an electrophotographic developer composition comprising a cold pressure fixable colored toner composition which comprises a core containing a polymer in which is dispersed pigment particles selected from the group consisting of cyan, magenta, red, yellow pigments, and mixtures thereof, other than carbon blacks and magnetites; and encapsulated within a polymeric shell formulated by an interfacial polymerization. Also, U.S. Pat. No. 4,725,522 discloses a process for preparing cold pressure fixable toner compositions which comprises admixing a core component comprising pigment particles, a water insoluble organic solvent and elastomeric materials with a shell monomer dissolved therein, dispersing the resulting mixture in a water phase. In addition, U.S. Pat. No. 4,766,051, the disclosure of which is totally incorporated herein by reference, discloses a cold pressure fixable colored toner composition comprising a core containing a polymer in which is dispersed colored pigment particles and an encapsulating polymeric shell formulated by an interfacial polymerization.

In addition, U.S. Pat. No. 4,628,019 discloses a single component, substantially nonmagnetic toner which comprises a colorant and a binder, said binder preferably comprising a copolymer of an aminoacrylic monomer and a vinyl monomer having a ($M_w/M_n$) (weight-average molecular weight ($M_w$) to number-average molecular weight ($M_n$) ratio) of less than 5.0. According to the teachings of this patent, the charging characteristics of the toner are improved by decreasing the $M_w/M_n$ ratio of the binder in that the quantity of static charge possessed by the toner is stabilized. As stated at column 5, lines 50 to 56, the charging characteristic of the resin which is the main component of the toner has a fundamental effect on stabilization of the charging characteristic of the toner, and the charging characteristic of the toner is improved by decreasing the $M_w/M_n$ ratio of the binder resin. The examples in this patent indicate that lowering the $M_w/M_n$ decreases the triboelectric charge fluctuations observed in the toners when the amount of iron or ferrite powder in the toner is varied. As stated at column 5, lines 44 to 47, the toner composition disclosed in the patent may also be adopted in the wall material, the core material, or both of a microcapsule toner.

Although known processes do not provide methods of passivating the toner pigments so that triboelectric charge is independent of the pigment contained therein, processes for controlling triboelectric characteristics of toners are known. For example, U.S. Pat. No. 4,613,559 discloses a process for obtaining colored toner compositions by dispersion polymerization, which comprises providing a monomer solution containing stabilizer, polymerizing the resulting mixture, adding to the mixture a dye solution comprising an organic solvent and oil soluble dyes, causing the dye solution to diffuse into the polmer particles, and separating the resulting toner particles, wherein the stabilizer is permanently attached to the toner polymer particles. The steric stabilizers that are permanently attached to the toner particle surfaces function as charge enhancing additives, and changing the stabilizer selected enables a triboelectric charging range of the toners disclosed of from −50 to +50 microcoulombs per gram.

In addition, U.S. Pat. No. 4,134,760, the disclosure of which is totally incorporated herein by reference, discloses developer compositions wherein the triboelectric charging potential of functional polymers employed in the toner materials are controlled through chemical acylation of hydroxyl and amino functions. The controlled variation of the triboelectric behavior of functional polymers by acylation provides a means of attaining optimum triboelectric responses in development systems. By varying the degree of chemical modification of polymeric materials for use as toner particles, either stoichiometrically or kinetically, the triboelectric properties of the developer material are controlled in a continuous manner.

Further, U.S. Pat. No. 4,070,296 discloses developer compositions wherein the triboelectric charging properties of functional polymers employed in the toner materials are controlled by systematic chemical modification. The functionalized polymers are covalently bonded with functional dyes to provide colored toner materials possessing controlled triboelectric properties and stable colorants. Additionally, U.S. Pat. No. 4,070,186 discloses developer compositions wherein the triboelectric charging potential of functional polymers employed in the toner materials are controlled through chemical alteration of active hydrogen containing materials by silylation. The controlled variation of the triboelectric behavior of functional polymers by silylation provides a means of attaining optimum triboelectric responses in development systems.

Copending application U.S. Ser. No. 043,265, filed 4/27/87, discloses an encapsulated composition suitable for use as an electrophotographic toner, which comprises a core encapsulated within a thermotropic liquid crystalline polymeric shell. On page 8 of this application, the specification states that the disclosed developer compositions can be charged to preselected values irrespective of the pigment selected for the core. This teaching, however, refers only to toner compositions comprising core components and liquid crystalline polymeric shells. In addition, copending application U.S. Ser. No. 128,851, filed 12/4/87, discloses an encapsulated toner composition with a melting temperature of from about 65° C. to about 140° C. which comprises a core containing a polymer selected from the group consisting of polyethylene succinate, polyhalogenated olefins, poly($\alpha$-alkylstyrenes), rosin modified maleic resins, aliphatic hydrocarbon resins, poly($\epsilon$-caprolactones), and mixtures thereof; and pigment particles, where the core is encapsulated in a shell prepared by interfacial polymerization reactions. The disclosure of this copending application is totally incorporated herein by reference containing a stabilizing material, hydrolyzing by heating the resulting mixture, subsequently effecting an interfacial polymerization of the mixture, and thereafter optionally washing the resulting toner composition.

Further, U.S. Pat 4,855,209, discloses an improved process for preparing encapsulated toner compositions which comprises mixing core monomers, an initiator, pigment particles, and oil soluble shell monomers, homgenizing the mixture into an aqueous surfactant solution to result in an oil-in-water supension enabling an interfacial polymerization reaction between the oil soluble and the water soluble shell monomers, subsequently adding a low molecular weight polyethylene oxide surfactant protective colloid, and thereafter effecting free-radical polymerization of the core monomers by heating. The disclosure of this U.S. Pat. 4,851,318 is totally incorporated herein by reference.

Although these compositions and processes are suitable for their intended purposes, a need continues to exist for improved heat fusible color toners suitable for use in electrophotographic copiers and printers. A need also exists for colored toners which exhibit low melting behavior, thereby enabling lower fusing temperatures. A further need exists for dry colored toners having an average mean diameter of less than 10 microns and a narrow size distribution. There is a further need for colored toners which charge positively or negatively in two component development, as well as a need for both positively and negatively charged toners for single component development systems. In addition, there is a need for processes for preparing heat fusible colored toners wherein the triboelectric characteristics of the toners may be controlled and predetermined. Further, a need exists for toner compositions having highly stabilized pigment dispersions with a wide choice of pigments for highlight and process color. In addition, a need exists for a process that enables colored toner particles to possess predetermined triboelectric charging characteristics independent of the pigment selected as a colorant. A further need exists for a process which enables production of toner particles with a mean particle diameter of less than 10 microns and a narrow size distribution without the need for micronization or classification. There is also a need for processes for preparing toners of different colors that can reach the same equilibrium levels of triboelectric charge when charged against the same carrier. In addition, there is a need for processes for preparing toners wherein the triboelectric charge of the toner is primarily determined by the shell material and/or by any charge control agents present. Further, a need exists for processes for preparing toners wherein the toner color can be modified without affecting the triboelectric charge of the toner.

SUMMARY OF THE INVENTION

It is an object of the present invention to provide a process for preparing improved heat fusible color toners suitable for use in electrophotographic copiers and printers.

It is another object of the present invention to provide a process for preparing colored toners which exhibit low melting behavior, thereby enabling lower fusing temperatures.

It is yet another object of the present invention to provide a process for preparing dry colored toners having an average mean diameter of less than 10 microns and a narrow size distribution.

Another object of the present invention is to provide a process for preparing colored toners which charge positively or negatively in two component development, as well as both positively and negatively charged toners suitable for single components development systems.

Still another object of the present invention is to provide a process for preparing heat fusible colored toners wherein the triboelectric characteristics of the toners may be controlled and predetermined.

Yet another object of the present invention is to provide a process for preparing toner composition having highly stabilized pigment dispersions with a wide choice of pigments for highlight and process color.

Another object of the present invention resides in the provision of a process that enables colored toner particles to possess triboelectric charging characteristics independent of the pigment selected as a colorant.

Still another object of the present invention resides in the provision of a process which enables production of toner particles with a mean particle diameter of less than 10 microns and a narrow size distribution without the need for micronization or classification.

Yet another object of the present invention resides in the provision of a process for preparing toners wherein toners of different colors can reach the same equilibrium levels of triboelectric charge when charged against the same carrier.

It is another object of the present invention to provide processes for preparing toners wherein the triboelectric charge of the toner is primarily determined by the shell material and/or by any charge control agents present.

It is still another object of the present invention to provide processes for preparing toners wherein the toner color can be modified without affecting the triboelectric charge of the toner.

These and other objects of the present invention are achieved by providing a process for controlling the electrical characteristics of colored toner particles, which process comprises preparing a first core material comprising first pigment particles, core monomers, a free radical initiator, and optional polymer components; preparing a second core material which comprises second pigment particles, core monomers, a free radical initiator, and optional polymer components, said second pigment particles being of a different color from that of the first pigment particles; dispersing the first and second core materials into an aqueous phase; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby producing two encapsulated heat fusible toner compositions of different colors with similar triboelectric charging characteristics.

BRIEF DESCRIPTION OF THE DRAWINGS

FIG. 2 also illustrates the passivation effect, or narrowing of the observed triboelectric charge range, for 4 toners prepared according to the process of the present invention with different pigments and encapsulated with a polyamide shell, and for 4 toners prepared according to the process of the present invention with different pigments and encapsulated with a polyurea shell.

DETAILED DESCRIPTION OF THE INVENTION

Figure 1:
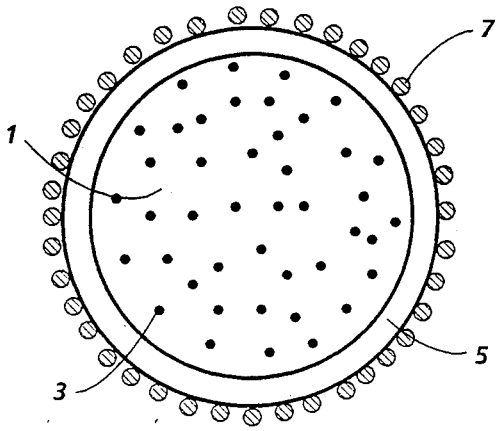
FIG. 1 illustrates an encapsulated toner particle prepared according to the process of the present invention.

The process of the present invention employs microencapsulation technology, wherein a hard thin polymeric shell having a relatively high glass transition temperature of from about 120° C. to about 300° C. is produced in an interfacial condensation polymerization process around a colored pigmented core material having a relatively low glass transition temperature. One feature of the present invention relates to the "passivation" of colored pigments. The pigments are buried inside the toner particle by dispersing them in the core material and completely and uniformly encapsulating the core material with the shell material. Thus, the shell serves to isolate and insulate the pigment particles from the outside environment, preventing the pigment from dominating or controlling the triboelectric properties of the toner particle. This isolation also enables long and stable developer lifetimes.

Once the microencapsulation by interfacial polymerization is complete, the particle size and particle size distribution are fixed and neither micronization nor classification is required. In addition, the carrier employed in two component development processes or the charging blade generally employed in single component development processes contacts only the polymeric encapsulating shell; thus, the triboelectric charging level is determined by the shell polymer and is independent of the molecular structure, morphology, or color of the particular pigment which is dispersed in the core material, meaning that the pigments have been effectively "passivated".

Another feature of the present invention relates to the shell material. Since the pigment no longer dominates the triboelectric charging characteristics of the toner, control and adjustment of this toner parameter is achieved by changing the molecular properties of the shell polymer. This adjustment can be achieved, for example, by modifying the chemical structure of the shell polymer while maintaining a high enough glass transition temperature for non-thermal blocking and mechanical integrity purposes, or by incorporating selected surface charge control additives into the shell during its formation while preserving adequate thermal and mechanical properties.

Still another feature of the present invention relates to fine tuning the required triboelectric charging level of the color toners, and to controlling the rate of charging of freshly added toner to a development system. Subsequent to the establishment of an initial triboelectric position by means of an appropriate choice of shell polymer (with or without added charge control agents), further modifications of the triboelectric charging level can be achieved through the use of selected surface charge control additives. These surface additives may be fumed silicas or aluminas or metal salts or other fine inorganic powders with particle sizes considerably less than 1 micron. These powders may themselves be untreated or treated with chemical agents which control charging and admix properties, such as those typically employed as toner charge control agents. The surface additives may be added to the toner in a number of ways, such as by dry blending the additives with the dry toner in a tumbling/shearing process such as a Lodige blender, or by adding additives to an aqueous suspension of the toner and spray drying the toner so that the additives cling to the surface. Alternatively, other drying equipment could be employed such as fluidized bed dryers or vacuum dryers.

Colored toner particles prepared according to the process of the present invention are illustrated in FIG. 1. FIG. 1 shows a polymeric core 1 containing pigment particles 3, an encapsulating polymeric shell 5, and optional surface additives 7 on the outside surface of the shell. Within the toner particles, the pigment particles are passivated by effectively burying them inside a microcapsule toner particle so that no pigment surfaces are exposed. The triboelectric charging level of the toner particle is controlled by the choice of the microcapsule shell polymer, or by both the choice of the shell polymer and the chosen surface charge control agents, resulting in the triboelectric charging level of the toner being essentially the same regardless of the specific colored pigment employed in the toner. Triboelectric charging levels of the colored toners can also be changed by employing different carrier materials in the triboelectric series of carriers, or by employing different frictional charging blade materials in single component development systems, resulting in the different carriers or charging blades moving the triboelectric position of each toner by the same amount, regardless of the particular pigment employed in the toner. In addition, the triboelectric charging levels of the colored toners may be changed by changing the chemical structure of the shell polymer, so that the different shell polymers move the triboelectric position of each toner by the same amount, regardless of the particular pigment employed in the toner. For example, the triboelectric characteristics of toners encapsulated with a polyurea material can be altered by selecting another polyurea as the encapsulating material. The triboelectric charging properties of the toners and the charging rates of the uncharged toner when admixed with charged toner can be further refined through the use of surface blended charge control additives, resulting in the triboelectric position of each toner being moved by the same amount, regardless of the particular color pigment employed in the toner. The control and latitude of the triboelectric properties can be depicted in the general diagram below.

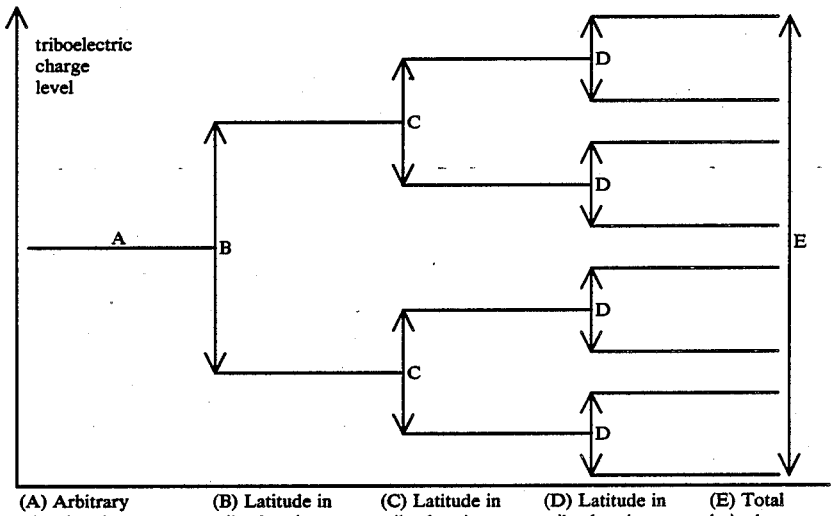

(A) Arbitrary triboelectric charging level for passivated encapsulated toners of all colors (B) Latitude in triboelectric level achieved for passivated encapsulated toners of all colors by varying the carrier (two-component development) or the charging blade (single component development)

(C) Latitude in triboelectric level achieved for passivated encapsulated toners of all colors by varying the composition of the shell polymer (D) Latitude in triboelectric level achieved for passivated encapsulated toners of all colors by addition of surface blended charge control additives (E) Total latitude obtainable As shown, an arbitrary triboelectric charging level of the toners prepared according to the process of the present invention is achieved as a result of the choice of shell composition and ingredients, carrier or charging blade, and presence and amount of charge control additives. This charging level may be adjusted by altering the carrier employed, if the toners are used in a two-component development process, or the charging blade used, if the toners are used in a single-component development process. Further adjustment of the triboelectric charging level may be effected by selecting a different polymeric shell with different charging characteristics for the encapsulated toners of the present invention. The triboelectric charging level of the toners may be adjusted still further by the addition of surface blended charge control additives. The latitude in triboelectric levels achievable by varying the composition of the shell polymer or by addition of surface charge control additives may be as broad as the range depicted for varying the carrier or the charging blade as shown in the diagram. Overlap between the levels is also possible. In each instance, the magnitude of the adjustment in triboelectric charge is essentially the same for each different colored toner. Preferably, the value of triboelectric charge selected for a set of colored encapsulated toners of the present invention is within the range generally preferred for the development of high quality images, which generally is at least about +10 microcoulombs per gram, preferably from about +10 to about +35 microcoulombs per gram, for positively charged toners, and at least about −10 microcoulombs per gram, preferably from about −10 to about −35 microcoulombs per gram, for negatively charged toners, although the selected tribo may be outside of this range provided that the objectives of the present invention are achieved.

The process of the present invention entails preparation of color toner compositions formulated by an interfacial/free-radical polymerization process in which the shell formation and the core formation are controlled independently. The core materials selected for the toner composition are blended together, followed by encapsulation of these core materials within a polymeric material, followed by core monomer polymerization. The encapsulation process generally takes place by means of an interfacial polymerization reaction, and the core monomer polymerization process generally takes by means of a free radical reaction. More specifically, the process includes the steps of preparing a core material by mixing a blend of a core monomer or monomers, one or more free radical polymerization initiators, a pigment or pigments, a first shell monomer, and, optionally, a core polymer or polymers; forming an organic liquid phase which is dispersed into an aqueous phase containing a water soluble surfactant to form an oil in water suspension; and addition of a water soluble second shell monomer during constant agitation, thus subjecting the mixture to an interfacial polymerization at room temperature. After the interfacial polymerization is complete, the free radical polymerization of the core monomers within the encapsulated core is effected by increasing the temperature of the suspension, thereby enabling the initiator to initiate polymerization of the core monomers and resulting in a toner composition comprising a polymeric core containing well-dispersed pigment and encapsulated by polymeric shell. Free radical polymerization of the core monomers generally is at a temperature of from about 50° C. to about 130° C., and preferably from abut 60° to about 120° C., for a period of from about 8 hours to about 24 hours. The toner material is then washed to remove the stabilizing materials and subsequently dried, preferably utilizing the spray drying technique. Further details regarding encapsulation by interfacial/free radial polymerization are illustrated in U.S. Pat. No. 4,727,011, the disclosure of which is totally incorporated herein by reference.

With respect to the polymeric core material, preformed polymers may be included as a component of the core. These polymers are compatible with and readily soluble in the core monomers. Examples of suitable polymers include polymers of the monomers listed below as suitable core monomers, as well as copolymers of these monomers, such as styrene-butadiene copolymers, styrene-acrylate and styrene-methacrylate copolymers, ethylene-vinylacetate copolymers, isobutylene-isoprene copolymers, and the like.

In addition, monomers are present in the core during the particle formation stop, and subsequently these monomers are polymerized in a free radical polymerization process after the shell has been formed in an interfacial polymerization process. Typical core monomers include styrene, α-methylstyrene, vinyl toluene, n-alkyl methacrylates, n-alkyl acrylates, branched alkyl methacrylates, branched alkyl-acrylates, chlorinated olefins, butadiene, styrene-butadiene oligomers, ethylene-vinyl acetate oligomers, isobutylene-isoprene copolymer of low molecular weight where the weight-average molecular weight ($M_w$) ranges from about 5,000 to about 20,000 having residual double bonds, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and the like. These monomers may be present alone or as mixtures of monomers to form copolymers. The monomers may also be present in conjunction with preformed polymers so that subsequent polymerization of the core monomer results in a polymer blend, which may be both a compatible blend, wherein the polymers are miscible and form a uniform, homogeneous mixture, or an incompatible blend, wherein one polymer is present in discrete regions or domains within the other polymer. In particular, it has been found that a "flush" of the desired organic pigment in a preformed polymer, for example Hostaperm Pink E in a copolymer resin consisting of about 65 percent by weight of styrene and about 35 percent by weight of n-butyl methacrylate, can be mixed with styrene and/or acrylate monomers to form the core material, and these monomers can be subsequently polymerized after shell formation to produce the fully polymerized core in which the dispersion of pigment is extremely uniform. For the process of the present invention, the different colored toners need not contain the same core monomers or polymers since the charging characteristics of the toners are determined by the shell material.

Waxes or wax blends may also be added to the core in amounts of from about 0.5 percent by weight to about 20 percent by weight of the core to improve the low melting properties and/or release properties of the toner. Specific examples of waxes include candelilla, bees wax, sugar cane wax, carnuba wax, paraffin wax and other similar waxes, particularly those with a melting point of about 60° C.

Any suitable colored pigments may be chosen for the process of the present invention, provided that they are unreactive with the components employed to form the shell in an interfacial polymerization process and that they do not interfere with the free radical polymerization of the core monomer or monomers. Typical pigments that may be used in the process are Violet Toner VT-8015 (Paul Uhlich), Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), Heliogen Blue L6900, L7020 (BASF), Heliogen Blue K6902, K6910 (BASF), Heliogen Blue D6840, D7080 (BASF), Sudan Blue OS (BASF), Neopen Blue FF4012 (BASF), PV Fast Blue B2G01 (American Hoechst), Irgalite Blue BCA (Ciba-Geigy), Paliogen Blue 6470 (BASF), Sudan III (red orange) (Matheson, Coleman, Bell), Sudan II (orange) (Matheson, Coleman, Bell), Sudan IV (orange) (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1355, D1351 (BASF), Hostaperm Pink E (American Hoechst, Fanal Pink D4830 (BASF), Cinquasia Magenta (DuPont), Paliogen Black L0084 (BASF), Pigment Black K801 (BASF), and carbon blacks such as Regal 330 ® (Cabot), Carbon Black 5250 and Carbon Black 5750 (Columbia Chemicals Company).

Any suitable free radical initiator may be employed if the core material is to be prepared by a free radical polymerization subsequent to the interfacial polymerization reaction that forms the toner shell, provided that the 10 hour half-life of the initiator is less than about 120° C., preferably less than about 90° C. Suitable free radical initiators include azo type initiators, such as 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,2'-azobis(2,4-dimethyl-4-methoxyvaleronitrile) or any combination thereof. Additional free radical initiators also include peroxide type initiators such as benzoyl peroxide, lauroyl peroxide and 2,5-dimethyl-2,5-bis(2-ethylhexanoylperoxy)hexane, Lupersol 256 ® (Pennwalt), or any combination thereof. Typically, a low temperature reacting initiator is present in the core material, being activated at temperatures of from about 50° C. to about 65° C. The low temperature initiator is generally present in an amount of from about 0.5 to about 6 percent by weight of the core monomers, and preferably from about 2 to about 4 percent by weight of the core monomers. Optionally, a high temperature initiator may also be present in the core material, being activated at temperatures of over 65° C. The high temperature initiator may be present in amounts of from 0 to about 2 percent by weight of the core monomers, and preferably from about 0.5 to about 1.25 percent by weight of the core monomers.

Suitable shell monomers generally are selected from monomers wherein the number of chemical reacting groups per molecule is two or more. The number of reacting groups per molecule is referred to as the chemical functionality. An organic soluble shell monomer which has a functionality of 2 or more reacts with an aqueous soluble shell monomer which has a functionality of 2 or more via interfacial polymerization to produce the shell polymer. Examples of organic soluble shell monomers with a functionality equal to 2 are sebacoyl chloride, terephthaloyl chloride, phthaloyl chloride, isophthaloyl chloride, azeloyl chloride, glutaryl chloride, adipoyl chloride and, hexamethylene diisocyanate purchased from Fluka; 4,4'-dicyclohexylmethane diisocyanate (Desmodur W) and a 80:20 mixture of 2,4- and 2,6-toluene diisocyanate (TDI) purchased from Mobay Chemical Corporation; trans-1,4-cyclohexane diisocyanate purchased from Aldrich and 4,4'-methyldiphenyl diisocyanate (Isonate 125M and MDI) purchased from The Upjohn Company. Examples of crosslinking organic soluble shell monomers which have a functionality greater than 2 are: 1,3,5-benzenetricarboxylic acid chloride purchased from Aldrich: Isonate 143L (liquid MDI based on 4,4'-methyldiphenyl diisocyanate) purchased from The Upjohn Co.; and tris(isocyanatophenyl) thiophosphate (Desmodur RF) purchased from Mobay Chemical Corporation. Examples of monomers soluble in aqueous media and with a functionality of 2 include 1,6-hexanediamine, 1,4-bis(3-aminopropyl)piperazine, 2-methylpiperazine, m-xylene-$\alpha,\alpha'$-diamine, 1,8-diamino-$p$-menthane, 3,3'-diamino-N-methyldipropylamine and 1,3-cyclohexanebis(methylamine) purchased from Aldrich; 1,4-diaminocyclohexane and 2-methylpentanediamine (Dyteck A) purchased from DuPont; 1,2-diaminocyclohexane, 1,3-diaminopropane, 1,4-diaminobutane, 2,5-dimethylpiperazine and piperazine purchased from Fluka; fluorine-containing 1,2-diaminobenzenes purchased from PCR Incorporated; and N,N'-dimethylethylenediamine purchased from Alfa. Other aqueous soluble shell monomers having a functionality greater than 2 are diethylenetriamine and bis(3-aminopropyl)amine obtained from Fluka and tris(2-aminoethyl)amine, (TREN-HP) purchased from W. R. Grace Company, and the like.

More than one organic phase monomer can be used to react with more than one aqueous phase monomer. Although formation of the shell entails reaction between at least two shell monomers, one soluble in organic phase and one soluble in aqueous phase, as many as 5 monomers soluble in organic phase and as many as 5 monomers soluble in aqueous phase can be reacted to form the shell. In some preferred instances, as many as 2 monomers soluble in organic phase and as many as 2 monomers soluble in aqueous phase can be reacted to form the shell.

Another class of shell monomers which can be used in the aqueous phase or the organic phase as minor shell components are functionalized prepolymers. Prepolymers or macromers are long chain polymeric materials which have low mechanical integrity and low molecular weights, such as weight-average molecular weights of less than 1000, but have functional groups on each end of the molecule that react with the shell monomers and can be incorporated into the shell. Examples of such materials that are available for use in the organic phase are isocyanate prepolymers such as Adiprene L-83 and L-167 from DuPont and the like. The class of Jeffamine materials such as Jeffamine ED-600, ED-900, C-346, DU-700 and EDR-148 from Texaco Chemical Company are aqueous prepolymers which can be incorporated into the shell as the aqueous soluble monomer and the like.

The color toner compositions generally comprise from about 5 to about 15 percent by weight, and preferably from about 6 to about 10 percent by weight, of the pigment or pigments, from about 5 to about 50 percent by weight, and preferably from about 7 to about 25 percent by weight, of the polymeric shell, and from about 35 to about 90 percent by weight, and preferably from about 65 to about 87 percent by weight, of the core monomers and polymers. Within the polymeric shell, the molar ratio of the organic soluble monomer to the aqueous soluble monomer is from about 1:1 to about 1:4, and preferably from about 1:1 to about 1:1.5. Within the mixture of core monomers and polymers, the preformed polymers are present in an amount of from 0 to about 40 percent by weight, preferably from about 20 to about 35 percent by weight, of the monomer/polymer mixture, and the monomers are present in an amount of from about 60 to about 100 percent by weight, preferably from about 65 to about 80 percent by weight, of the monomer/polymer mixture. An example of the process of the present invention for the preparation of color toner compositions entails:

(1) preparing a core component comprising (a) selected pigment particles, such as Hostaperm Pink E, in an amount of about 7 percent by weight of the toner, wherein the pigment is flushed into a resin comprising a styrene-n-butylmethacrylate copolymer (about 65 percent styrene and about 35 percent n-butyl methacrylate), which resin is present in an amount approximately equal to the amount (by weight) of the pigment particles;

(b) an additional preformed polymer, for example a styrene-n-butyl methacrylate copolymer (about 52 percent by weight of styrene and about 48 percent by weight of n-butyl methacrylate), present in an amount such that the total percent weight of this preformed polymer plus the preformed polymer into which the pigment has been flushed is about 35 percent by weight of the core monomer/polymer mixture component of the toner;

(c) a core monomer of mixture of monomers, present in an amount of about 65 percent by weight, of the core monomer/polymer mixture component of the toner, wherein the total amount of monomers plus preformed polymers is about 73 percent by weight of the toner;

(d) an initiator or initiators, present in an amount of from about 0.5 to about 6 percent by weight of the core monomer, and preferably from about 2 to about 4 percent by weight of the core monomer, for a low temperature reacting initiator, and from about 0 to about 2 percent by weight of the core monomer, and preferably from about 0.5 to about 1.25 percent by weight of the core monomer, for a higher temperature reacting initiator; and (e) an organic shell monomer dissolved in the core monomers, present in an amount of about 10 percent by weight of the toner composition;

(2) dispersing the resulting homogeneous mixture into a water phase containing a surfactant or emulsifier and, optionally, a base and/or an anti-foaming component such as an aliphatic alcohol such as 2-decanol;

(3) adding the water soluble second shell component in an amount of about 10 percent by weight of the toner to the mixture while agitating the dispersed core component and organic soluble shell component of the toner in the stabilizing aqueous phase at room temperature, thus effecting interfacial polymerization;

(4) after about 2 hours of constant agitation at room temperature, increasing the temperature of the suspension to a temperature of from about 50° C. to about 130° C. and preferably from about 60° C. to about 120° C. for about 8 hours to about 24 hours, and preferably from about 8 hours to about 18 hours, thereby effecting free radical polymerization of the core monomers;

(5) thereafter washing the toner thus formed to removed the stabilizing materials; and (6) subsequently drying the final toner product, preferably employing the spray drying process.

Shell polymers suitable for use with the present invention include those which may be formed in an interfacial polymerization process. Typical shell polymers include polyureas, polyurethanes, polyesters, thermotropic liquid crystalline polyesters, polycarbonates, polyamides, polysulfones, and the like, or mixtures of these polymers such as poly(urea-urethanes), poly(ester-amides), and the like, which can be formed in a polycondensation reaction of suitably terminated prepolymers or macromers with different condensation monomers. For example, a preformed alcohol terminated urethane prepolymer can be copolymerized with a diacyl halide to form a poly(ester-urethane) in an interfacial reaction, or an amine terminated amide prepolymer can be copolymerized with a diisocyanate to produce a poly(urea-amide) copolymer. Epoxy monomers or oligomers such as Epikote 819 can also be added in amounts of from about 0.01 percent to about 30 percent to copolymerize into the shell as strengthening agents. Various polyfunctional shell monomers, such as triamines, triisocyanates, and triols can be employed in small quantities of from about 0.01 percent to about 30 percent as crosslinking agents to introduce rigidity and strength into the shells.

A surfactant or emulsifier is generally added to disperse the hydrophobic particles in the form of toner size droplets in the aqueous medium and for stabilization of these droplets against coalescence or agglomeration prior to shell formation and encapsulation of the core. Many types of surfactants can be employed, such as polyvinylalcohol, polyethylene sulfonic acid salt, polyvinylsulfate ester salt, carboxylated polyvinylalcohol, water soluble alkoxylated diamines or similar water soluble block copolymers, gum arabic, polyacrylic acid salt, carboxymethylcellulose, hydroxypropylcellulose, hydroxyethylcellulose, quaternary amine functionalized cellulose derivatives such as JR 400, block copolymers of propylene oxide and ethylene oxide, gelatin, phthated gelatin, and succinated gelatin salts of alginic acid. In addition, water soluble inorganic salts may also be employed to stabilize the dispersion, such as trisodium polyphosphate, tricalcium polyphosphate, and the like.

Examples of interfacial polymerization processes suitable for formation of the polymeric shell are illustrated in U.S. Pat. Nos. 4,000,087 and 4,307,169, the disclosures of which are totally incorporated herein by reference.

After the latitude of tribo has been determined by the selected shell materials, the next largest factor controlling the triboelectric charge of the toners prepared by the process of the present invention is the choice of carrier. Through frictional contact between the carrier and the toner, an electrostatic charge sufficient for development of an electrostatic latent image is produced on the toner and maintained at a predetermined level. Examples of suitable carriers include a carrier comprising a ferrite core spray coated with a thin layer of a methyl terpolymer comprising about 81% methyl methacrylate, about 14% styrene and about 5% vinyl triethoxysilane; a carrier comprising a non-round, oxidized steel shot core coated with a thin layer of a polymer comprising about 65% trifluorochloroethylene and about 35% vinyl chloride blended with carbon black; a carrier comprising a steel shot core coated with polyvinylidene fluoride; a carrier comprising a steel shot core coated with a polymer blend comprising about 35% by weight of polyvinylidene fluoride and about 65% by weight of polymethylmethacrylate; and a carrier comprising a ferrite core coated with a methyl terpolymer comprising about 81% methyl methacrylate, about 14% styrene and about 5% vinyltriethoxysilane blended with carbon black. Other known carriers may be employed to achieve the desired triboelectric charge on the toner.

Surface charge control agents or additives can be added to the toner particles via numerous routes. These agents can be incorporated into the shell by adding the agent to the surfactant or emulsifier phase so that during interfacial polymerization of the shell the surface charge control agent is physically incorporated into the shell. This process is particularly suitable when one portion of the charge control agent is functionalized with a group such as an amine, so that the charge control agent reacts as a minor aqueous shell component and is chemically incorporated into the shell. During the interfacial polymerization, the surface charge control agent diffuses toward the outer boundary of the shell and is thus located on the shell surface. Examples of surface charge control agents suitable for incorporation into the shell material include fumed or colloidal silicas such as the Aerosils® aluminas, talc powders, metal salts, metal salts of fatty acids such as zinc stearate, cetyl pyridinium salts, distearyl dimethyl ammonium methyl sulfate, and the like. Preferably the charge control agents are colorless compounds so as not to interfere with the purity of color of the toners. Generally, the surface charge enhancing additives when incorporated as a component of the shell are present in an amount of from about 0.1 percent to about 20 percent by weight of the aqueous shell component.

Surface charge control agents can also be blended onto the surface of the toner particles subsequent to particle formation. After particle formation and just prior to spray drying, the surface charge control agent can be added to the aqueous suspension of the washed particles, so that during the spray drying process the charge control agent adheres to the shell surface. Surface charge control additives can also be dry blended onto the dry toner surface in a tumbling/shearing apparatus such as a Lodige blender. Examples of surface charge control additives suitable for addition to the toner surface include fumed silicas or fumed metal oxides onto the surface of which have been deposited charge enhancing additives such as cetyl pyridinium chloride, distearyl dimethyl ammonium methyl sulfate, potassium tetraphenyl borate and the like. These surface treated silicas or metal oxides are typically treated with 5 to 25 percent of the charge enhancing agent. The surface charging agents that can be physically absorbed to the toner surface by mechanical means are generally present in an amount of from about 0.01 percent to about 15 percent by weight of the toner and preferably from about 0.1 percent to about 5 percent by weight of the toner.

Formation of the toner particles by an interfacial polymerization reaction followed by a free radical polymerization of the core monomers results in toner particles having a highly smooth toner particle morphology. The core can be polymerized subsequent to shell formation, yet the viscosity of the pigmented core compositions is low enough to allow the dispersion of the core in the aqueous surfactant solution during the primary particle generation step. In most forms of microencapsulation, the core consists of a preformed polymer dissolved in a solvent prior to dispersion in the aqueous phase, as illustrated in, for example, U.S. Pat. Nos. 4,476,211; 4,476,212 and 4,610,945, to achievea sufficiently low viscosity to allow efficient dispersion of both the pigments in the core polymer and dispersion of the organic phase into the aqueous phase. The presence of a solvent in the core, however, may cause several problems. First, if the solvent is high boiling and not removed on drying of the toner, the imaged toners may have very poor smear properties, and there may also be odor problems and environmental problems associated with, for example, chlorinated solvents, which can also be possible carcinogens. The solvent recovery step is expensive, and the manufacturing equipment for particle isolation generally must be explosion proof, which also adds to the process cost. If the solvent for the core polymer is low boiling and can be removed on drying of the toner, then, since the particle size is fixed by the interfacial polymerization process while the solvent is still present, the toner particles will collapse to form very wrinkled prune-like particles or collapsed disc-like particles if the shell is sufficiently flexible. This effect generally results in very poor flow properties of the toner, and generates complications in the particle preparation process necessitating recovery of the solvent. Alternatively, if the particles have shells which are very rigid, upon escape of the solvent, large voids will be apparent inside the toner capsule resulting in a low bulk density of the toner and a lack of image density for a fixed volume of toner developed. In some instances, escaping solvent can cause the toner shells to explode, or may create holes in the shell on drying. These difficulties are avoided by employing a process as described herein, wherein the polymeric core is formed by a free radical polymerization subsequent to the formation of the shell.

In addition, the shell of the microencapsulated toner prepared according to the aforementioned process has a high enough glass transition temperature, that is, greater than about 60° C., to provide adequate blocking properties and mechanical properties of the toner particles. Thus, there is no constraint upon the major polymer component of the toner, the core polymer, to have a glass transition temperature as high as 55° C. to 60° C., as is the situation with conventional melt-blended toners. Core polymerizations by free radical mechanisms may be designed to produce low melting and low energy fusing core polymers that fuse and melt at temperatures of from about −60° C. to about 60° C., which considerably widens the choice of free radical polymerization monomers suitable for use in toner compositions of this type as compared to the choice available for toners prepared by melt-blending methods.

Figure 2:
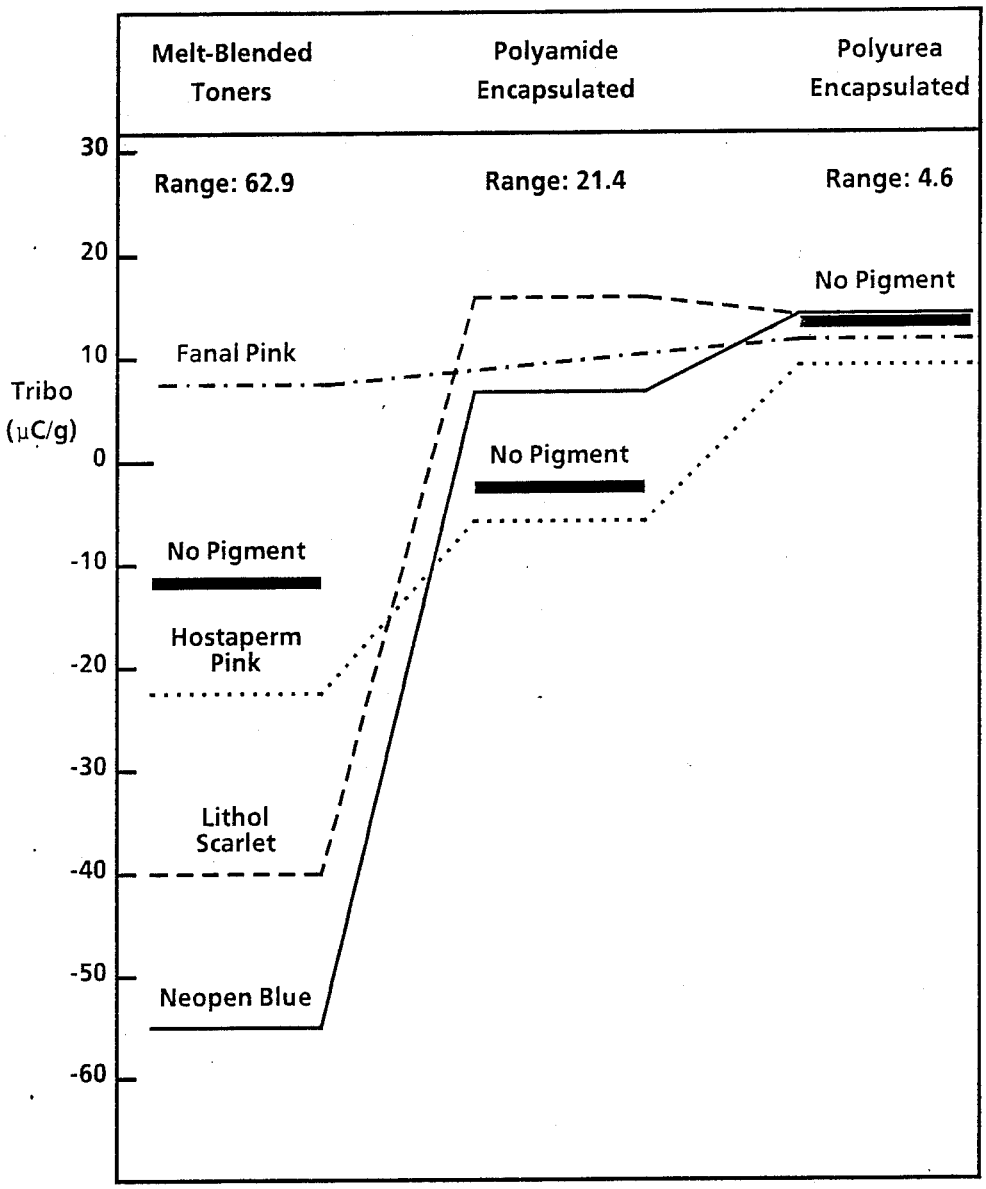
FIG. 2 depicts the range of triboelectric charges observed for 4 conventional melt-blended toners with different pigments.

The resulting toner compositions have essentially the same triboelectric charging characteristics. In addition, some preferred polymeric shell materials can further enhance the passivation effect. For example, as illustrated in Example I below, three different colored encapsulated toners with the same pigment concentration and polyamide shells prepared from the interfacial polymerization between terephthaloyl chloride and 1,6-hexanediamine can be triboelectrically charged to −6.0 microcoulombs per gram for a Hostaperm Pink E pigmented toner, +6.3 microcoulombs per gram for a Neopen Blue pigmented toner, and +15.4 microcoulombs per gram for a Lithol Scarlet pigmented toner. The tribo charging range covered by this set of three differently colored toners with polyamide shells is 21.4 units. A second example of four different colored encapsulated toners with the same pigment concentration and polyurea shells prepared from the interfacial polymerization between Isonate 143L and diethylenetriamine and tris(2-aminoethyl)amine can be triboelectrically charged to +9.6 microcoulombs per gram for a Hostaperm Pink E pigmented toner, +11.5 microcoulombs per gram for a Fanal Pink pigmented toner, +14.1 microcoulombs per gram for a Lithol Scarlet pigmented toner, and +14.2 microcoulombs per gram for a Neopen Blue pigmented toner. The tribo charging range covered by this set of four differently pigmented toners with polyurea shells is 4.6 units. The tribo data for the polyamide encapsulated toners and the polyurea encapsulated toners can be compared to data obtained for an identically pigmented set of toners prepared by the conventional melt-blending, micronization, and classification method. The tribo values for the melt-blended toners are −55 microcoulombs per gram for a Neopen Blue pigmented toner, −40 microcoulombs per gram for a Lithol Scarlet pigmented toner, −21.8 microcoulombs per gram for a Hostaperm Pink E pigmented toner, and +7.9 microcoulombs per gram for a Fanal Pink pigmented toner. The tribo range covered by these four differently pigmented toners prepared by melt-blending is 62.9 units. The tribo ranges for these three sets of toners can also be graphically represented as shown in FIG. 2. Narrowing of the tribo range from 62.9 units for the melt blended toners to 21.4 units for the toners with polyamide shells illustrates the passivation effect obtained with the process of the present invention. A further narrowing of the tribo range to only 4.6 units for the toners with polyurea shells further illustrates the extent of the passivation effect obtainable with preferred shell materials.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Three colored heat fusible microencapsulated toners were prepared by the following procedure. Into a 250 milliliter polyethylene bottle was added 15.3 grams of a styrene monomer (Polysciences Inc.), 61.3 grams of an n-butyl methacrylate monomer (Polysciences Inc.), 22.4 grams of a copolymer comprising about 52 percent by weight of styrene and 48 percent by weight of n-butyl methacrylate, and 21.0 grams of mixture of Hostaperm Pink E pigment (Hoechst) predispersed into a styrene/n-butyl methacrylate copolymer comprising 65 percent by weight of styrene and 35 percent by weight of n-butyl methacrylate, wherein the pigment to copolymer ratio is 50/50 by weight. The polymer and pigment were dispersed into the monomer for 24 to 48 hours on a Burrell wrist shaker. Subsequently, into two additional 250 milliliter polyethylene bottles were added 15.3 grams of styrene monomer to each bottle (Polysciences Inc.), 61.3 grams of n-butyl methacrylate monomer to each bottle (Polysciences Inc.). Additionally, to one bottle was added 20.0 grams of a styrene/n-butyl methacrylate copolymer comprising about 52 percent by weight of styrene and 48 percent by weight of n-butyl methacrylate, and 23.3 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55. To the second bottle was added 22.4 grams of a styrene/n-butyl methacrylate copolymer wherein the percent by weight of styrene to n-butyl methacrylate was 52/48, and 21.0 grams of a mixture of Neopen Blue FF-4012 pigment (BASF) flushed into a styrene/n-butyl methacrylate copolymer comprising 65 percent by weight of styrene and 35 percent by weight of n-butyl methacrylate, wherein the pigment to polymer ratio was 50/50. The two pigmented monomer/polymer mixtures were placed on a Burrell wrist shaker for 24 to 48 hours to disperse the polymer and pigment into the monomer, resulting in toner compositions comprising 7 percent by weight of pigment, 20 percent by weight shell, and 73 percent by weight of the mixture of core monomers and polymers, which mixture comprised 30 percent by weight preformed polymer and 70 percent by weight monomer. The remaining portion of the procedure was repeated for all 3 pigmented cores. Once the pigmented monomer solution was homogeneous, into each mixture was dispersed 19.0 grams of terephthaloyl chloride (Aldrich), 3.066 grams of 2,2'-azobis(2,4-dimethylvaleronitrile) (Polysciences Inc.), and 0.766 grams of 2,2'-azobisisobutyronitrile (Polysciences Inc.) by shaking the bottles on a Burrell wrist shaker for 10 minutes. Into a stainless steel 2 liter beaker containing 600 milliliters of 0.5% polyvinylalcohol solution, weight-average molecular weight of 96,000, 88% hydrolyzed (Scientific Polymer Products) and 0.1% sodium dodecyl sulfate (Aldrich) was dispersed the pigmented monomer solution with a Brinkmann PT45/80 homogenizer and PTA-35/4G probe at 10,000 rpm for 3 minutes. The dispersion was performed in a cold water bath at a temperature of 15° C. Subsequently, the dispersion was transferred into 2 liter glass reactor equipped with a mechanical stirrer and an oil bath under the beaker. While stirring the solution vigorously, an aqueous solution of 11.0 grams of 1,6-hexanediamine (Aldrich), 13.0 grams of sodium carbonate (Fisher Scientific), and 100 milliliters of distilled water was poured into the reactor and the mixture was stirred for 2 hours at room temperature. During this time, the interfacial polymerization occurred to form a noncrosslinked polyamide shell around the core material. While still stirring, the volume of the reaction mixture was increased to 1.5 liters with 1.0% polyvinylalcohol solution, and an aqueous solution containing 1.0 gram of potassium iodide (Aldrich) dissolved in 10.0 milliliters of distilled water was added. The pH of the solution was adjusted to pH 7 to 8 with dilute hydrochloric acid (BDH) and then heated for 12 hours at 85° C. while still stirring. During this time the monomeric material underwent free radical polymerization to complete formation of the polymeric core. The solution was then cooled to room temperature and was washed 10 times with distilled water by settling the particles by gravity. The particles were screened wet through 425 and 250 micron sieves and were then spray dried with a Yamato-Ohkawara spray dryer model DL-41.

A fourth toner was prepared for comparative purposes with the same composition and by the same method, except that it contained no pigment.

The total yield after spray drying of the Neopen Blue toner was 58.5 percent, with the average particle size being 14.1 microns with a GSD of 1.38 as measured on a Coulter Counter. The Hostaperm Pink E pigmented toner was produced with a 59.7 percent yield, with the average particle size being 14.6 microns with a GSD of 1.43. The Lithol Scarlet pigmented toner was produced with a 60.7 percent yield, with an average particle size being 18.0 microns with a GSD of 1.40. The total yield after spray drying of the nonpigmented sample was 52.7 percent, with the average particle size being 14.7 microns with a GSD of 1.36 as measured on a Coulter Counter.

When measuring the tribo charging characteristics of the toner, the toner and carrier samples were conditioned overnight in a Tappi Room wherein the room remained at a constant temperature of 22° C. and constant humidity of 50% RH. Four developers were then prepared by mixing 3 grams of each of the toners with 97 grams of a carrier comprising a ferrite core spray coated with a thin layer of a methyl terpolymer comprising 81% methyl methacrylate, 14% styrene, and 5% vinyl triethoxysilane. The toner and carrier were weighed into a 250 milliliter glass bottle and agitated on a paint shaker for 10 minutes. The tribo data was measured on a blow-off apparatus using 1.0 to 1.5 grams of the developer. As a result of contact with the carrier, the toners became triboelectrically charged. The toner containing Neopen Blue pigment exhibited a triboelectric charge (tribo) of +6.3 microcoulombs per gram, the toner containing Lithol Scarlet pigment exhibited a tribo of +15.4 microcoulombs per gram, and the toner containing Hostaperm Pink E pigment exhibited a tribo of −6.0 microcoulombs per gram. The unpigmented toner exhibited a tribo of −2.0 microcoulombs per gram. The tribo values for the three toners containing three different pigments thus ranged over 21.4 tribo units, which indicates a significant decrease in tribo range compared to the tribo range of 62.9 units reported in Example III for toners prepared by the melt-blending process. It is believed that images of high quality and image resolution, with no background deposits and excellent image fix, can be formed by blending each of these colored encapsulated toners with a charge control additive in an amount of from about 0.01 percent to about 15 percent by weight of the toner prior to mixing them with the carriers, incorporating the developers comprising these toners and carriers into electrophotographic imaging devices, forming latent images, developing the latent images with the developers, transferring the developed images to substrates such as paper or transparency material, and fusing the developed images by application of heat.

EXAMPLE II

Four colored heat fusible microencapsulated toners were prepared as follows. Into a 250 milliliter polyethylene bottle was added 15.3 grams of styrene monomer (Polysciences Inc.), 61.3 grams of n-butyl methacrylate monomer (Polysciences Inc.), 22.4 grams of a copolymer comprising about 52 percent by weight of styrene and about 48 percent by weight of n-butyl methacrylate, and 21.0 grams of a mixture of Hostaperm Pink E pigment (Hoechst) predispersed into a styrene-n-butyl methacrylate copolymer comprising 65 percent by weight of styrene and 35 percent by weight of n-buty methacrylate, wherein the pigment to copolymer ratio is 50/50. With the aid of a Burrell wrist shaker, the polymer and pigment were dispersed into the monomer for 24 to 48 hours. Into three additional 250 milliliter polyethylene bottles were added 15.3 grams of styrene monomer to each bottle (Polysciences Inc.) and 61.3 grams of n-butyl methacrylate monomer to each bottle (Polysciences Inc.). Additionally, to one bottle was added to 20.0 grams of a styrene-n-butyl methacrylate copolymer comprising about 52 percent by weight of styrene and 48 percent by weight of n-butyl methacrylate, and 23.3 grams of a mixture of Lithol Scarlet NBD-3755 pigment (BASF) flushed into a styrene-n-butyl methacrylate copolymer comprising 65 percent by weight of styrene and 35 percent by weight of n-butyl methacrylate, wherein the pigment to copolymer ratio was 45/55. To the second bottle was added 22.4 grams of a styrene-n-butylmethacrylate copolymer wherein the percent by weight ratio of styrene to n-butylmethacrylate was 52/48, and 21.0 grams of a mixture of Neopen Blue FF-4012 pigment (BASF) flushed into a styrene-n-butyl methacrylate copolymer comprising 65 percent by weight of styrene and 35 percent by weight of n-butyl methacrylate, wherein the pigment to polymer ratio was 50/50. To the third bottle was added 17.1 grams of a styrene-n-butyl methacrylate copolymer wherein the percent by weight ratio of styrene to n-butyl methacrylate was 52/48, and 26.3 grams of a mixture of Fanal Pink D4830 pigment (BASF) flushed into a styrene-n-butyl methacrylate copolymer comprising 65 percent by weight of styrene and 35 percent by weight of n-butyl methacrylate, wherein the pigment to polymer ratio was 40/60. All three pigmented monomer/polymer mixtures were placed on a Burrell wrist shaker for 24 to 48 hours to disperse the polymer and pigment into the monomer. The composition thus formed comprised 7 percent by weight of pigment, 20 percent by weight shell, and 73 percent by weight of the mixture of core monomers and polymers, which mixture comprised 30 percent by weight performed polymer and 70 percent by weight monomer. The remaining portion of the procedure was repeated for all 4 pigmented cores. Once the pigmented monomer solution was homogeneous, into the mixture was dispersed 20.0 grams of liquid isocyanate (tradename Isonate 143L or liquid MDI) (Upjohn Polymer Chemicals), 3.066 grams of 2,2'-azobis(2,4-dimethyl-valeronitrile), Polysciences Inc., and 0.766 grams of 2,2'-azobis-isobutyronitrile (Polysciences Inc.) by shaking the bottles on a Burrell wrist shaker for 10 minutes. Into a stainless steel 2 liter beaker containing 600 milliliters of 0.5% polyvinylalcohol solution, weight-average molecular weight of 96,000, 88% hydrolyzed (Scientific Polymer Products) and 0.1% sodium dodecyl sulfate (Aldrich), was dispersed the pigmented monomer solution with a Brinkmann PT45/80 homogenizer and a PTA-35/4G probe at 10,000 rpm for 3 minutes. The dispersion was performed in a cold water bath at a temperature of 15° C. Subsequently, the dispersion was transferred into a 2 liter glass reactor equipped with a mechanical stirrer and an oil bath under the beaker. While stirring the solution vigorously, an aqueous solution of 7.7 grams of diethylenetriamine (Aldrich), 2.7 grams of tris(2-aminoethyl)amine, tradename Tren-HP (W. R. Grace) and 100 milliliters of distilled water was poured into the reactor and the mixture was stirred for 2 hours at room temperature. During this time, an interfacial polymerization reaction between the shell monomers occurred to form a crosslinked polyurea shell around the core material. While still stirring, the volume of the reaction mixture was increased to 1.5 liters with 1.0% polyvinylalcohol solution and an aqueous solution containing 0.5 gram of potassium iodide (Aldrich) dissolved in 10.0 milliliters of distilled water was added. The pH of the solution was adjusted to pH 7 to 8 with dilute hydrochloric acid (BDH) and then heated for 12 hours at 85° C. while still stirring. During this time the monoms in the core underwent a free radical polymerization reaction to complete formation of the core material. The solution was cooled to room temperature and was washed 10 times with distilled water by settling the particles by gravity. The particles were screened wet through 425 and 250 micron sieves and then spray dried using a Yamato-Ohkawara spray dryer model DL-41.

A fifth toner was prepared for comparative purposes with the same composition and by the same method, except that it contained no pigment.

The total yield after spray drying was 67.7 percent, with the average particle size being 15.4 microns with a GSD of 1.41 as determined by a Coulter Counter for the Lithol Scarlet pigmented toner. The Neopen Blue toner after spray drying produced a yeld of 58.2 percent, with the average particle size being 13.6 microns with a GSD of 1.48. The Hostaperm Pink E toner exhibited a yield of 69.3 percent, with the average particle size being 12.1 microns with a GSD of 1.34. The Fanal Pink pigmented toner exhibited a yield of 61.9 percent, with the average particle size being 12.8 microns with a GSD of 1.50. The total yield after spray drying of the nonpigmented sample was 70.9 percent, with the average particle size being 10.8 microns and with a GSD of 1.37 as measured on a Coulter Counter.

When measuring the triboelectric charging characteristics of the toners, the toner and carrier samples were conditioned overnight in a Tappi Room wherein the room was kept at a constant temperature of 22° C. and constant humidity of 50% RH. Five developers were then prepared by mixing 3 grams of each of the toners with 97 grams of a carrier which comprised a ferrite core spray coated with a thin layer of a methyl terpolymer comprising 81 percent methyl methacrylate, 14 percent styrene and 5 percent vinyl triethoxysilane. The toner and carrier were weighed into a 250 milliliter glass bottle and agitated on a paint shaker for 10 minutes. The tribo data was measured on a blow-off apparatus using 1.0 to 1.5 grams of the developer. As a result of contact with the carrier, the toners became triboelectrically charged. The toner containing Neopen Blue pigment exhibited a triboelectric charge (tribo) of +14.2 microcoulombs per gram, the toner containing Lithol Scarlet pigment exhibited a tribo of +14.1 microcoulombs per gram, the toner containing Hostaperm Pink E pigment exhibited a tribo of +9.6 microcoulombs per gram, and the toner containing Fanal Pink pigment exhibited a tribo of +11.5 microcoulombs per gram. The unpigmented toner exhibited a tribo of +13.4 microcoulombs per gram. The tribo values for the four toners containing four different pigments thus ranged over 4.6 tribo units, which indicates a significant decrease in tribo range compared to the range of 62.9 units reported in Example III for toners prepared by melt blending. It is believed that images of high quality and image resolution, with no background deposits and excellent image fix, can be formed by blending each of these colored encapsulated toners with a charge control additive in an amount of from about 0.01 percent to about 15 percent by weight of the toner prior to mixing them with the carriers, incorporating the developers comprising these toners and carriers into electrophotographic imaging devices, forming latent images, developing the latent images with the developers, transferring the developed images to substrates such as paper of transparency material, and fusing the developed images by application of heat.

EXAMPLE III

Four colored toners comprising a styrene-butadiene resin and, respectively, Neopen Blue pigment, Lithol Scarlet pigment, Hostaperm Pink E pigment, and Fanal Pink pigment were prepared as follows. A Davo Twin-Screw Extruder was used to prepare all of the conventionally colored toners. Two K-tron volumetric screw feeders were employed to feed a styrene/butadiene copolymer resin comprising about 87 percent by weight of styrene and about 13 percent by weight of butadiene, and pigment to produce 6 percent loading of pigment in the polymer resin at a combined feed rate of 20 grams per minute into the extruder. There were three temperature control zones and one die in the extruder. The first control zone was set at 120° C. and the other two zones and die were set at 130° C. The screw speed of the extruder was adjusted to 60 rpm prior to feeding in the materials. The extrudate was subsequently air cooled and chopped into small pieces by a Berlyn Pelletizer, and the pelletized material was ground into a smaller particle size of 850 microns by a Model J Fitzmill and then a micronizer further reduced the toner to a desired particle size of 11.4 μm±1 μm.

Four developers were then prepared by mixing 3 grams of each of the toners with 97 grams of a carrier comprising a ferrite core spray coated with a thin layer of a methyl terpolymer comprising 81 percent methyl methacrylate, 14 percent styrene, and 5 percent vinyl triethoxysilane. When measuring the triboelectric charging characteristics of the toners, the toner and the carrier samples were conditioned overnight in a Tappi Room wherein the room was kept at a constant temperature of 22° C. and constant humidity of 50% RH. For each of the four different pigmented toners, 100 grams of developer was prepared by weighing 3 grams of toner and 97 grams of carrier into a 250 milliliter glass bottle and agitating the developer on a paint shaker for 10 minutes. The tribo data was measured with a tribo blow-off apparatus using 1.0 to 1.5 grams of the mixed developer.

As a result of contact with the carrier, the toners became triboelectrically charged. The toner containing Neopen Blue pigment exhibited a triboelectric charge (tribo) of −55 microcoulombs per gram, the toner containing Lithol Scarlet pigment exhibited a tribo of −40 microcoulombs per gram, the toner containing Hostaperm Pink E pigment exhibited a tribo of −21.8 microcoulombs per gram, and the toner containing Fanal Pink pigment exhibited a tribo of +7.9 microcoulombs per gram. The tribo values for the four toners containing four different pigments thus ranged over 62.9 tribo units.

By way of example to illustrate the diversity and scope of materials that can be used in the encapsulation process the following additional examples are included.

EXAMPLE IV

A color heat fusible microencapsulated toner was prepared using the following procedure. Into a 250 milliliter polyethylene bottle was added 39.4 grams of a styrene monomer (Polysciences Inc.), 26.3 grams of an n-butyl methacrylate monomer (Polysciences Inc.), 43.8 grams of a 52/48 ratio of styrene/n-butyl methacrylate copolymer resin, 10.5 grams of Lithol Scarlet D3700 pigment (BASF), and 5 millimeter diameter ball bearings which occupied 40 to 50 percent by volume of the total sample. This sample was ball milled for 24 to 48 hours to disperse the pigment particles into the monomer/polymer mixture. The composition thus formed comprised about 7 percent by weight of pigment, about 20 percent by weight of shell polymer, and about 73 percent by weight of the mixture of core monomers and polymers, which mixture comprised about 40 percent by weight of a styrene-n-butyl methacrylate copolymer with about 52 percent by weight of styrene and about 48 percent by weight of n-butyl methacrylate, about 35 percent by weight of styrene monomer, and about 24 percent by weight of n-butyl methacrylate monomer. After ball milling, 250 milliliters of the pigmented monomer solution was transferred into another polyethylene bottle, and into the solution was dispersed with a Brinkmann PT45/80 homogenizer and a PTA-20TS probe for 1 minute at 6,000 rpm 10.2 grams of terephthaloyl chloride (Fluka), 8.0 grams of 1,3,5-benzenetricarboxylic acid chloride, (Aldrich), 263 grams of 2,2'-azo-bis(2,4-dimethylvaleronitrile), (Polysciences Inc.), and 0.66 grams of 2,2'-azo-bis-isobutyronitrile (Polysciences Inc.). Into a stainless steel 2 liter beaker containing 500 milliliters of an about 2.0 percent by weight polyvinylalcohol solution, weight-average molecule weight 96,000, about 88 percent by weight hydrolyzed (Scientific Polymer Products), and 0.5 milliliters of 2-decanol (Aldrich), was dispersed the above pigmented monomer solution with a Brinkmann PT45/80 homogenizer and a PTA-35/4G probe at 10,000 rpm for 3 minutes. The dispersion was performed in a cold water bath at 15° C. This mixture was transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water was added dropwise over a 2 to 3 minute period. Simultaneously, from a separatory dropping funnel a basic solution comprising 13.0 grams of sodium carbonate (Baker) and 30 milliliters of distilled water was also added dropwise over a 10 minute period. After complete addition of the amine and base solutions, the mixture was stirred for 2 hours at room temperature. During this time the interfacial polymerization occurred to form a polyamide shell around the core material. While still stirring, the volume of the reaction mixture was increased to 1.5 liters with distilled water, and an aqueous solution containing 3.0 grams of potassium iodide (Aldrich) dissolved in 10.0 milliliters of distilled water was added. After the initial 2 hours and continuous stirring, the temperature was increased to 65° C. for 4 hours to initiate the free radical polymerization of the core. Following this 4 hour period, the temperature was increased again to 85° C. for 8 hours to complete the core polymerization and to minimize the amount of residual monomers encapsulated by the shell. The solution was then cooled to room temperature and was washed 7 times with distilled water by settling and decanting off the supernatant. Before spray drying, the particles were screened through 425 and 250 micron sieves and then spray dried using a Yamato-Ohkawara spray dryer model DL-41. The total yield of the toner after spray drying was 42 percent, with the average particle size being 14.5 microns with a GSD of 1.7 as determined with a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE V

A color heat fusible microencapsulated toner was prepared by repeating the process of Example IV except for the following changes. Into a 250 milliliter polyethylene bottle was added 46.0 grams of styrene monomer (Polysciences Inc.) instead of 39.4 grams, 30.65 grams of n-butyl methacrylate monomer (Polysciences Inc.) instead of 26.3 grams, 32.85 grams of a 52/48 ratio of styrene/n-butyl methacrylate copolymer resin, instead of 43.8 grams and 10.5 grams of Lithol Scarlet D3700 pigment (BASF), which were ball milled together as stated in Example IV. Similar to Example IV, the overall toner composition remained the same except for these minor changes. After ball milling, 3.066 grams of 2,2'-azo-bis(2,4-dimethylvaleronitrile), (Polysciences Inc.) instead of 2.63 grams, 0.7655 gram of 2,2'-azo-bis-isobutyronitrile (Polysciences Inc.) instead of 0.66 gram, 10.2 grams of terephthaloyl chloride (Fluka), and 8.0 grams of 1,3,5-benzenetricarboxylic acid chloride (Aldrich) were dispersed into the pigmented organic solution as stated in Example IV. The organic phase was homogenized into 1 liter of a 2.0 percent by weight polyvinylalcohol solution, weight-average molecular weight 96,000, 88% hydrolyzed (Scientific Polymer Products) instead of 500 milliliters, and 0.5 milliliters of 2-decanol (Aldrich) with a Brinkmann PT45/80 homogenizer and a PTA-35/4G generator probe at 10,000 rpm for 4 minutes. After the particles were spray dried, the average particle size was 11.0 microns with a GSD of 1.70 as determined with a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE VI

A color heat fusible microencapsulated toner was prepared using the following procedure. Into a 250 milliliter polyethylene bottle was added 10.5 grams of Lithol Scarlet D3700 (BASF), 52.56 grams of styrene monomer (Polysciences Inc.), 35.04 grams of n-butyl methacrylate monomer (Polysciences Inc.), 21.9 grams of a 52/48 ratio of styrene/n-butyl methacrylate copolymer resin, and 5 millimeter diameter ball bearings which occupied 40 percent by volume of the total sample. This sample was ball milled overnight for approximately 17 hours to disperse the pigment particles into the monomer/polymer mixture. The composition thus formed comprised 7 percent by weight pigment, 20 percent by weight shell material, and 73 percent by weight of the mixture of core monomers and polymers, wherein the mixture comprised 20 percent polymeric resin, a 52/48 styrene/n-butyl methacrylate monomer ratio, 48 percent styrene monomer, and 32 percent n-butyl methacrylate. After ball milling, the pigmented monomer solution was transferred into another 250 milliliter polyethylene bottle, and into this was dispersed with a Brinkmann PT45/80 homogenizer and a PTA-20TS generator probe at 5,000 rpm for 30 seconds 12.0 grams of sebacoyl chloride (Aldrich), 8.0 grams of 1,35-benzenetricarboxylic acid chloride (Aldrich), 1.8055 grams of 2,2'-azo-bis(2,3-dimethylvaleronitrile), (Polysciences Inc.), and 0.5238 gram of 2,2'-azo-bis-isobutyronitrile, (Polysciences Inc.). Into a stainless steel 2 liter beaker containing 500 milliliters of 2.0% polyvinylalcohol solution, weight-average molecular weight 96,000, 88% hydrolyzed (Scientific Polymer Products), 0.3 gram of potassium iodide (Aldrich), and 0.5 milliliter of 2-decanol (Aldrich) was dispersed the above pigmented organic phase with a Brinkmann PT45/80 homogenizer and a PTA-20TS probe at 10,000 rpm for 1 minute. The dispersion was performed in a cold water bath at 15° C. This mixture was transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water was added dropwise over a 2 to 3 minute period. Simultaneously, from a separatory dropping funnel a basic solution comprising 13.0 grams of sodium carbonate (Baker) and 30 milliliters of distilled water was also added dropwise over a 10 minute period. After complete addition of the amine and base solutions, the mixture was stirred for 2 hours at room temperature. During this time, interfacial polymerization occurred to form a polyamide shell around the core materials. While stirring, the volume of the reaction mixture was increased to 1.5 liters with distilled water, followed by increasing the temperature to 54° C. for 12 hours to polymerize the core monomers. The solution was then cooled to room temperature and was washed 7 times with distilled water by settling the particles and decanting off the supernatant. Before spray drying, the particles were screened through 425 and 250 micron sieves and then spray dried using a Yamato-Ohkawara spray dryer model DL-41 with an inlet temperature of 120° D. and an outlet temperature of 65° C. The average particle size was 14.5 microns with a GSD value of 1.66 as determined with a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE VII

A color heat fusible microencapsulated toner was prepared by the following procedure. Into a 250 milliliter polyethylene bottle was added 10.5 grams of Lithol Scarlet D3700 (BASF), 65.7 grams of styrene monomer (Polysciences Inc.), and 43.8 grams of n-butyl methacrylate monomer (Polysciences Inc.), which were blended together using a Burrell wrist shaker overnight. Similar to Examples IV to VI, the composition comprised 7 percent by weight pigment, 73 percent by weight of the mixture of core monomers and polymers, and 20 percent by weight shell, with the core monomer/polymer mixture in this Example containing no preformed polymeric resin, but rather 60 percent by weight styrene monomer and 40 percent by weight n-butyl methacrylate monomer. Using a Brinkmann PT45/80 homogenizer and a PTA-20TS generator probe for 30 seconds at 5,000 rpm, 16.0 grams of sebacoyl chloride (Aldrich), 4 grams of 1,3,5-benzenetricarboxylic acid chloride (Aldrich), 2.2204 grams of 2,2'-azo-bis(2,4-dimethylvaleronitrile), (Polysciences Inc.), and 0.5709 gram of 2,2'-azo-bis-isobutylonitrile (Polysciences Inc.), were mixed in with the pigmented monomer mixture. Into a stainless steel 2 liter beaker containing 500 milliliters of a 2.0% polyvinylalcohol solution, weight-average molecular weight 96,000, 88% hydrolyzed, (Scientific Polymer Products), 0.1023 gram of potassium iodide (Aldrich), and 0.5 milliliters of 2-decanol (Aldrich) was dispersed the above pigmented organic phase with a Brinkmann PT45/80 homogenizer and a PTA-20TS generator probe at 10,000 rpm for 1 minute. The resulting solution was transferred into a 2 liter reaction kettle equipped with a mechanical stirrer and an oil bath. While stirring at room temperature, an amine solution comprising 10 grams of diethylene triamine (Aldrich) in 25 milliliters of distilled water was added dropwise over a 2 to 3 minute period. During this time an interfacial polymerization reaction occurred to form a polyamide shell around the core material. Simultaneously, a basic solution containing 12.0 grams of sodium carbonate (Baker), in 25 milliliters of distilled water was added over a 10 minute period to react with the HCl liberated in the polyamide reaction. After continuous stirring for 2 hours at room temperature, the sample volume was increased with 2.0% polyvinylalcohol solution, and the temperature of the reaction was increased to 54° C. for 12 hours to polymerize the core monomers via free-radical polymerization. The solution was cooled to room temperature, followed by washing the particles 6 times with distilled water. The particles were spray dried using a Yamato-Ohkawara spray dryer model DL-41. The average particle size determined by a Coulter Counter was 9.2 microns with a GSD value of 1.42. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE VIII

A color heat fusible microencapsulated toner was prepared using the following procedure. Into a 250 milliliter polyethylene bottle was added 39.4 grams of styrene monomer (Polysciences Inc.), 26.3 grams of n-butyl methacrylate monomer (Polysciences Inc.), 438 grams of a 52/48 ratio of styrene/n-butyl methacrylate copolymer resin, 10.5 grams of Lithol Scarlet D3700 pigment (BASF), and 5 millimeter diameter ball bearings which occupied 40 to 50 percent by volume of the total sample. This sample was ball milled for 24 to 48 hours to disperse the pigment particles into the monomer/polymer mixture. The composition thus formed comprised 7 percent by weight of pigment, 20 pigment by weight shell and 73 percent by weight of the mixture of core monomers and polymers, which mixture comprised 40 percent by weight of preformed polymer, (52% styrene/48% n-butyl methacrylate), 36 percent by weight styrene monomer, and 24 percent by weight n-butyl methacrylate monomers. After ball milling, the pigmented monomer solution was transferred into another 250 milliliter polyethylene bottle, and into this was dispersed with a Brinkmann PT45/80 homogenizer and a PTA-20TS probe for 1 minute at 6,000 rpm 22.9 grams of a liquid isocyanate (trademark Isonate 143 L, Upjohn Polymer Chemicals), 2.63 grams of 2,2'-azo-bis(2,4-dimethylvaleronitrile), (Polysciences Inc.), and 0.66 gram of 2,2'-azo-bis-isobutyronitrile, (Polysciences Inc.). Into a stainless steel 2 liter beaker containing 500 milliliters of 2.0% polyvinylalcohol solution, weight-average molecular weight 96,000, 88% hydrolyzed (Scientific Polymer Products) and 0.5 milliliters of 2-decanol (Aldrich) was dispersed the above pigmented monomer solution with a Brinkmann PT45/80 homogenizer and a PTA-35/4G probe at 10,000 rpm for 3 minutes. The dispersion was performed in a cold water bath at 15° C. This mixture was transferred into a 2 liter glass reactor equipped with a mechanical stirrer and an oil bath under the beaker. While stirring the solution vigorously, an aqueous solution of 8.0 grams of diethylene triamine (Aldrich), 5.0 grams of 1,6-hexanediamine (Aldrich), and 25 milliliters of distilled water was added dropwise over a 2 to 3 minute period. After complete addition of the amine solution, the mixture was stirred for 2 hours at room temperature. During this time interfacial polymerization occurred to form a polyurea shell around the core material. While still stirring, the volume of the reaction mixture was increased to 1.5 liters with distilled water and an aqueous solution containing 2.0 grams of potassium iodide (Aldrich) dissolved in 10.0 milliliters of distilled water was added. After the initial 2 hours and continuous stirring, the temperature was increased to 65° C. for 4 hours to polymerize the core monomers. Following this 4 hour period, the temperature was increased again to 85° C. for 8 hours to complete the core polymerization and to minimize the amount of residual monomers encapsulated by the shell. The solution was then cooled to room temperature and was washed 7 times with distilled water by settling and decanting off the supernatant. Before spray drying, the particles were screened through 425 and 250 micron sieves and then spray dried using a Yamato-Ohkawara spray dryer model DL-41. The total yield after spray drying was 44.5 percent, with the average particle size being 12.0 microns with a GSD of 1.83 as determined by a Coulter Counter. The particles were spherical in shape and the pigment was dispersed throughout the core. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE IX

A color heat fusible microencapsulated toner was prepared by the following procedure. Into a 250 milliliter polyethylene bottle was added 13.1 grams of styrene monomer (Polysciences Inc.), 52.6 grams of n-butyl methacrylate monomer (Polysciences Inc.), 33.3 grams of a 52/48 ratio of styrene/n-butyl methacrylate copolymer resin, and 21.0 grams of a mixture of Sudan Blue OS pigment (BASF) flushed into a 65/35 ratio of styrene/n-butyl methacrylate copolymer resin wherein the pigment to polymer ratio was 50/50. With the aid of a Burrell wrist shaker, the polymer and pigment were dispersed into the monomers for 24 to 48 hours. The composition thus formed comprised 7 percent by weight of pigment, 20 percent by weight shell, and 73 percent by weight of the mixture of core monomers and polymers, which mixture comprised 9.6 percent copolymer resin (65/35 ratio of styrene/n-butyl methacrylate monomers), 30.4 percent copolymer resin (52/48 ratio of styrene/n-butyl methacrylate monomers), 12 percent styrene monomer, and 48.0 percent n-butyl methacrylate monomer. Once the pigmented monomer solution was homogeneous, into this mixture was dispersed with a Brinkmann PT45/80 homogenizer and a PTA-20TS probe for 30 seconds at5,000 rpm 20.0 grams of liquid isocyanate (tradename Isonate 143L or liquid MDI), (Upjohn Polymer Chemicals), 1.314 grams of 2,2'-azo-bis(2,4-dimethylvaleronitrile) (Polysciences Inc.), and 0.657 gram of 2,2'-azo-bis-isobutyronitrile (Polysciences Inc.). Into a stainless steel 2 liter beaker containing 600 milliliters of 1.0% polyvinylalcohol solution, weight-average molecular weight 96,000, 88% hydrolized (Scientific Polymer Products) and 0.5 milliliters of 2-decanol (Aldrich) was dispersed the above pigmented monomer solution with a Brinkmann PT45/80 homogenizer and a PTA-35/4G probe at 10,000 rpm for 1 minute. The dispersion was performed in a cold water bath at 15° C. This mixture was transferred into a 2 liter reactor equipped with a mechanical stirrer and an oil bath under the beaker. While stirring the solution vigorously, an aqueous solution of 5.0 grams of diethylene triamine (Aldrich), 5.0 grams of 1,6-hexanediamine (Aldrich), and 100 milliliters of distilled water was poured into the reactor and the mixture was stirred for 2 hours at room temperature. During this time interfacial polymerization occurred to form a polyurea shell around the core material. While still stirring, the volume of the reaction mixture was increased to 1.5 liters with 1.0% polyvinylalcohol solution and an aqueous solution containing 0.5 gram of potassium iodide (Aldrich) dissolved in 10.0 milliliters of distilled water was added. The pH of the solution was adjusted to pH 7 to 8 with dilute hydrochloric acid (BDH) and was then heated for 12 hours at 85° C. while still stirring. During this time, the monomeric material in the core underwent free radical polymerization to complete formation of the core material. The solution cooled to room temperature and was washed 7 times with distilled water. The particles were screened wet through 425 and 250 micron sieves and then spray dried using a Yamato-Ohkawara spray dryer model DL-41. The total yield after spray drying was 58.2 percent, with the average particle size being 164 microns with a GSD of 1.41 as determined by a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE X

A color heat fusible microencapsulated toner was prepared by repeating the process of Example IX except for the following changes. The flushed pigment used was not Sudan Blue OS (BASF) flushed into a 65/35 styrene/n-butyl methacrylate copolymer resin, but 21.0 grams of a mixture of Hostaperm Pink E (Hoechst) dispersed into the same copolymer resin at a 50/50 ratio. After core polymerization, the particles were washed 7 times, screened through 425 and 250 micron sieves, and finally spray dried using the Yamato-Ohkawara spray dryer model DL-41. The total percent yield after spray drying was 55.2 percent, with an average particle size of 15.8 microns and a GSD value of 1.42 as determined by a Coulter Counter model T&TA. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE XI

A color heat fusible microencapsulated toner was prepared by repeating the process of Example IX except for the following changes. The pigment used was not Sudan Blue OS (BASF) flushed into a 65/35 styrene/n-butyl methacrylate copolymer resin, but 21.0 grams of a mixture of Hostaperm Pink E (Hoechst) dispersed into the same copolymer resin at a 50/50 ratio. The dispersion of the pigmented organic phase into 600 milliliters of 0.5% polyvinylalcohol solution, weight-average molecular weight 96,000, 88% hydrolyzed (Scientific Polymer Products) and 0.5 milliliters of 2-decanol (Aldrich) was performed with a Brinkmann PT45/80 homogenizer and a PTA-35/4G probe at 10,000 rpm for 1 minute. While stirring the solution in the reactor, an aqueous solution of 7.7 grams of diethylene triamine (Aldrich) and 2.7 grams of N,N'-bis(2-aminoethyl)-1,2-ethenediamine (tradename TREN-HP) (W. R. Grace & Company) in 100 milliliters of distilled water was poured into the reactor and the mixture was stirred for 2 hours at room temperature. After spray drying, 72.2 grams or 48 percent yield of the material was recovered. The average particle size was 17.7 microns, with a GSD value of 1.48 as determined by a Coulter Counter. The particles were spherical with a smooth surface and the pigment was evenly distributed throughout the core of the particle. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE XII

A color heat fusible microencapsulated toner was prepared by repeating the process of Example IX except for the following changes. Into a 250 milliliter polyethylene bottle was added 15.33 grams of styrene monomer (Polysciences Inc.) instead of 13.1 grams, 61.32 grams of n-butyl methacrylate monomer (Polysciences Inc.) instead of 52.6 grams, 22.35 grams of a 52/48 ratio of styrene/n-butyl methacrylate preformed copolymer resin instead of 33.3 grams, and 210 grams of a mixture of Hostaperm Pink E pigment (Hoechst) predisposed 50/50 into a 65/35 ratio of styrene/n-butyl methacrylate copolymer resin. The Burrell wrist shaker was used to disperse the solids into the monomers for 24 to 48 hours. The composition thus formed comprised 7 percent by weight of pigment, 20 percent by weight shell, and 73 percent by weight of the mixture of core monomers and polymers, which mixture comprised 9.6 percent 65/35 ratio of styrene/n-butyl methacrylate copolymer resin, 20.4 percent copolymer resin which is a 52/48 ratio of styrene/n-butyl methacrylate, 56.0 percent n-butyl methacrylate monomer, and 14.0 percent styrene monomer. The weight of initiators dispersed with liquid MDI into the pigmented monomer solution for 2,2'-azo-bis(2,4-dimethylvaleronitrile) (Polysciences Inc.) was 3.066 grams instead of 1.314 grams and for 2,2'-azo-bis-isobutylronitrile (Polysciences Inc.) was 0.766 grams instead of 0.657 grams. The concentration of polyvinylalcohol solution, weight-average molecular weight 96,000, 88% hydrolyzed (Scientific Polymer Products), was changed from 1.0% to 0.5%. The length of dispersion of the organic pigmented phase into the polyvinylalcohol solution was increased from 1 minute to 3 minutes at 10,000 rpm with the PTA-35/4G probe. The amine solution when added comprised 8.5 grams of diethylene triamine (Aldrich) and 15 grams of N,N'-bis(2-aminoethyl)-1,2-ethenediamine (tradename TREN-HP), (W. R. Grace & Company) in 100 milliliters of distilled water, instead of diethylene triamine and 1,6-hexanediamine. The total yield of material after spray drying was 79.18 grams of 52.8 percent, with the average particle size being 17.2 microns with a GSD of 1.44 as determined by a Coulter Counter. The specific gravity of the pigmented toner sample thus formed was 1.13 grams per cubic centimeter, compared to 1.07 grams per cubic centimeter for a copolymer resin which is a 65/35 ratio of styrene/n-butyl methacrylate and 1.08 grams per cubic centimeter for a copolymer resin which is composed of a 52/48 ratio of styrene/n-butyl methacrylate as measured with an Autopycnometer (Micromeritics). Discrete spherical particles were produced with smooth particle surfaces. It is believed that images of high quality and image resolution, with no background deposits and excellent image fix, can be formed by blending this colored encapsulated toner with a charge control additive in an amount of from about 0.1 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE XIII

A color heat fusible microencapsulated toner was prepared by repeating the process of Example XII except for the following changes. Into the pigmented monomer solution was dispersed 17.0 grams of liquid isocyanate (tradename Isonate 143L or liquid MDI), (Upjohn Polymer Chemicals), 1.8 grams of terephthaloyl chloride (Fluka), and 1.2 grams of 1,35-benzenetricarboxylic acid chloride (Aldrich). The initiators dispersed into the pigmented monomer solution comprised 1.533 grams of 2,2'-azo-bis(2,4-dimethylvaleronitrile( (Polysciences Inc.), instead of 3.066 grams, and 0.766 gram of 2,2'-azo-bis-isobutyronitrile (Polysciences Inc.). The shell comprised 20 percent polyamide and 80 percent polyurea. The concentration of the polyvinylalcohol solution (Scientific Polymer Products) was 0.75% instead of 0.5%. The length of dispersion of the organic phase into the aqueous phase was 2 minutes instead of 3 minutes at 10,000 rpm with the PTA-35/4G probe. The total yield of toner after spray drying was 65.17 grams, or 43.4 percent, with the average particle size being 16.2 microns with a GSD value of 1.53 as determined by a Coulter Counter. The discrete particles were spherical in shape with some wrinkling of the shell, which can be attributed to the polyamide content. It is believed that images of high quality and images resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE XIV

A color heat fusible microencapsulated toner was prepared by repeating the process of Example XIII except for the following changes. The composition of the shell in this example was 80 percent polyamide and 20 percent polyurea, with 5.0 grams of liquid isocyanate (Upjohn Polymer Chemicals) instead of 17.0 grams, 9.0 grams of terephthaloyl chloride (Fluka) instead of 1.8 grams, and 6.0 grams of 1,3,5-benzene tricarboxylic acid chloride (Aldrich) instead of 1.2 grams. The total yield after spray drying was 58.64 grams, or 39.1 percent, with the average particle size being 16.5 microns with a GSD of 1.48 as determined by a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

EXAMPLE XV

A colored heat fusible encapsulated toner was prepared by the following procedure. Into a 500 milliliter polyethylene bottle was added 80 grams of styrene (Polysciences Inc.), 9 grams of Lithol Scarlet D3700 (BASF), and 24 grams of a styrene-n-butyl methacrylate copolymer of glass transition temperature of 55° C. This polymeric core solution was ball milled at room temperature for 16 hours with about ½ by volume of 5 milliliter diameter ball bearings to produce a well dispersed pigmented solution. In a separate bottle was dissolved 16.5 grams of p-p'-biphenol and 9.1 grams of sodium hydroxide in 100 milliliters of water. The ball milled solution was then transferred to a 100 milliliter polyethylene bottle (without the balls). To this 72.1 gram mixture was then added 1.5 grams of 2,2'-azo-bis-isobutylronitrile (Polysciences Inc.), 1.5 grams of 2,2'-azo-bis-(2,4-dimethylvaleronitrile) (Polysciences Inc.), and 21.0 grams of sebacoyl chloride (Aldrich, 99+%). The resulting solution was placed in a cold water bath at 15° C. for 10 minutes and then homogenized with a Brinkmann PT45/80 equipped with a PT-10ST generator probe at 40,000 rpm for 1 minute. The homogenized mixture was then dispersed with a PTA-45/6G probe for 20 seconds at 9,500 rpm into an aqueous solution (cooled with cold water for half an hour) of 600 milliliters of 1.33% polyvinylalcohol (Scientific Polymer Products, 88% hydroxylated, weight-average molecular weight 10,000), 1.5 grams of benzyl triethylammonium chloride, and 0.5 milliliter of 2-decanol (Aldrich). The dispersion was transferred into a 2 liter reactor equipped with a mechanical stirrer, a reflux condenser, and a heating bath under it. While stirring, the previously prepared p,p'-biphenol solution was added slowly over a period of ten minutes. The pH was monitored every 15 minutes for the first 2 hours and less frequently afterwards, and as required, it was adjusted with a solution of low concentration of sodium hydroxide to pH 8 to 10. The dispersion was kept at room temperature for 1½ hours after transfer to the reactor. During this time, an interfacial polymerization reaction occured between the sebacoyl chloride and the p,p'-biphenyl to yield a polyester shell with a melting point of 100° C. to 175° C. Subsequently, 2.5 grams of potassium iodide was added to the dispersion, which was then heated to 65° C. for a period of 4 hours. The temperature was increased from 65° to 85° C. over a period of one hour and a half and then heated at this temperature setting for 10 hours. The resulting material was washed three times (the particle settling by gravity each time) with a basic sodium hydroxide aqueous solution (pH=10). The water medium was then acidified (pH=3) with hydrochloric acid and washed three more times with distilled water. Subsequently, the washed particles were spray dried with a Yamato DL-41 spray dryer, inlet temperature of 130° C. and outlet temperature of about 55° C., to yield 56.4 grams of toner particles having an average particle size of 11.0 microns with a geometric standard deviation of 1.50 as determined with a Coulter Counter. It is believed that images of high quality and image resolution, with no background deposits and excellent image fix, can be formed by blending this colored encapsulated toner with a charge control additive in an amount of from about 0.01 percent to about 15 percent by weight of the toner prior to mixing it with a carrier, incorporating the developer comprising this toner and a carrier into an electrophotographic imaging device, forming latent images, developing the latent images with the developer, transferring the developed images to substrates such as paper or transparency material, and fusing the developed images by application of heat.

These examples are illustrative in nature and are not intended to limit the scope of the invention. Other embodiments of the present invention may occur to those skilled in the art, and these are included within the scope of the claims.

What is claimed is:

1. A process for controlling the electrical characteristics of colored toner particles which comprises preparing a first core material comprising first pigment particles, core monomers, and a free radical initiator; preparing a second core material which comprises second pigment particles, core monomers, and a free radical initiator, said second pigment particles being of different color from that of the first pigment particles; dispersing the first and second core materials into an aqueous phase; encapsulating separately the first core material and the second core material within polymeric shells by interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby producing two encapsulated toner compositions of different colors with similar triboelectric charging characteristics.

2. A process according to claim 1 wherein the two resulting toner compositions have mean particle diameters of less than 10 microns.

3. A process according to claim 1 wherein the two resulting toner compositions have mean particle diameters of from about 5 to about 8 microns.

4. A process according to claim 1 wherein the core monomers present in the first and second core materials are independently selected from the group consisting of styrene, α-methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and mixtures thereof.

5. A process according to claim 1 wherein the first and second core materials contain up to 5 core monomers.

6. A process according to claim 1 wherein the free radical polymerization initiators present are selected from the group consisting of 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), benzoyl peroxide, lauryl peroxide, 2,5-dimethyl-2,5-bis(2-ethylhexanoylperoxy)hexane, Lupersol 256® and mixtures thereof.

7. A process according to claim 1 wherein the initiators are present in an amount of from about 0.5 to about 8 percent by weight of the core monomer.

8. A process according to claim 1 wherein said first core components and said second core components comprise at least one polymeric material prior to free radical polymerization.

9. A process according to claim 8 wherein said polymeric material is selected from the group consisting of styrene-butadiene copolymers, styrene-acrylate copolymers, styrene-methacrylate copolymers, ethylene-vinylacetate copolymers, isobutylene-isoprene copolymers, and mixtures thereof.

10. A process according to claim 8 wherein the polymeric material is a polymer containing monomers selected from the group consisting of styrene, α-methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and mixtures thereof.

11. A process according to claim 8 wherein the ratio of the amount of the core monomers to the amount of the polymeric material is from about 0:100 to about 40:60.

12. A process according to claim 8 wherein the core monomers and the polymeric material are present in a total amount of from about 35 to about 90 percent by weight of the toner compositions.

13. A process according to claim 1 wherein said first core material and said second core material also comprise a wax selected from the group consisting of candelilla, bees wax, sugar cane wax, carnuba wax, paraffin wax and mixtures thereof.

14. A process according to claim 13 wherein the wax is present in said first core material and said second core material in an amount of from about 0.5 percent to abut 20 percent by weight of the core.

15. A process according to claim 1 wherein said first shell monomers are selected from the group consisting of sebacoyl chloride, terephthaloyl chloride, phthaloyl chloride, isophthaloyl chloride, azeloyl chloride, glutaryl chloride, adipoyl chloride, hexamethylene diisocyanate, a 1:1 mixture of 2,2',4- and 2,4,4'-trimethylhexamethylene diisocyanate, Isophorone diisocyanate, m-tetramethylxylene diisocyanate, ρ-tetramethylxylene diisocyanate, 4,4'-dicyclohexylmethane diisocyanate, an 80:20 mixture of 2,4- and 2,6-toluene diisocyanate, trans-1,4-cyclohexane diisocyanate, 4,4'-methyldiphenyl diisocyanate, 1,3,5-benzenetricarboxylic acid chloride, Isonate 143L, tris(isocyanatophenyl) thiophosphate, and mixtures thereof.

16. A process according to claim 1 wherein said second shell monomers are selected from the group consisting of 1,6-hexanediamine, 1,4-bis(3-aminopropyl)-piperazine, 2-methylpiperazine, m-xylene-α,α-diamine, 1,8-diamino-ρ-menthane, 3,3'-diamino-N-methyldipropylamine, 1,3-cyclohexanebis(methylamine), 1,4-diaminocyclohexane, 2-methylpentanediamine, 1,2-diaminocyclohexane, 1,3-diaminopropane, 1,4-diaminobutane, 2,5-dimethylpiperazine, piperazine, fluorine-containing 1,2-diaminobenzenes, N,N'-dimethylethylenediamine, diethylenetriamine, bis(3-aminopropyl)amine), tris(2-aminoethyl)amine, and mixtures thereof.

17. A process according to claim 1 wherein said first shell monomers are selected from the group consisting of sebacoyl chloride, terephthaloyl chloride, phthaloyl chloride, isophthaloyl chloride, azeloyl chloride, glutaryl chloride, adipoyl chloride, hexamethylene diisocyanate, a 1:1 mixture of 2,2',4- and 2,4,4'-trimethylhexamethylene diisocyanate, Isophorone diisocyanate, m-tetramethylxylene diisocyanate, ρ-tetramethylxylene diisocyanate, 4,4'-dicyclohexylmethane diisocyanate, a 80:20 mixture of 2,4- and 2,6-toluene diisocyanate, trans-1,4-cyclohexane diisocyanate, 4,4'-methyldiphenyl diisocyanate, 1,3,5-benzenetricarboxylic acid chloride, Isonate 143L, tris(isocyanatophenyl) thiophosphate, and mixtures thereof and said second shell monomers are selected from the group consisting of 1,6-hexanediamine, 1,4-bis(3-aminopropyl)piperazine, 2-methylpiperazine, m-xylene-α,α'-diamine, 1,8-diamino-ρ-menthane,3,3'-diamino-N-methyldipropylamine, 1,3-cyclohexanebis(methylamine), 1,4-diaminocyclohexane, 2-methylpentanediamine, 1,2-diaminocyclohexane, 1,3-diaminopropane, 1,4-diaminobutane, 2,5-dimethylpiperazine, piperazine, Isophorone diamine, a 1:1 mixture of 2,2',4- and 2,4,4'-trimethylhexamethylenediamine, N,N'-dimethylethylenediamine, diethylenetriamine, bis(3-aminopropyl)amine, tris(2-aminoethyl)amine, and mixtures thereof.

18. A process according to claim 1 wherein the polymeric shell is selected from the group consisting of polyureas, polyurethanes, polyesters, thermotropic liquid crystalline polyesters, polycarbonates, polyamides, polysulfones, poly(urea-urethanes), poly(ester-amides), poly(urea-amides), poly(ester-urethane), and mixtures thereof.

19. A process according to claim 1 wherein the polymeric shell is present in an amount of from about 5 to about 50 percent by weight of the toner.

20. A process according to claim 1 wherein from 2 to about 10 shell monomers undergo interfacial polymerization to form the shell.

21. A process according to claim 20 wherein 3 shell monomers undergo interfacial polymerization to form the shell.

22. A process according to claim 1 wherein a surface charge control agent is incorporated into the polymeric shells during their formation.

23. A process according to claim 22 wherein said charge control agent is selected from the group consisting of fumed silicas, colloidal silicas, aluminas, talc powders, metal salts, metal salts of fatty acids, cetyl pyridinium salts, distearyl dimethyl ammonium methyl sulfate, and mixtures thereof.

24. A process according to claim 22 wherein the surface charge control agent, when incorporated into the polymeric shells, is present in an amount of from about 0.1 to about 20 percent by weight of the shell monomer soluble in aqueous media.

25. A process according to claim 1 wherein a charge control agent is added to the surface of the polymeric shells subsequent to their formation.

26. A process according to claim 25 wherein the charge control agent is selected from the group consisting of particles selected from the group consisting of fumed silicas and fumed metal oxides, and wherein upon the surfaces of the particles have been deposited charge enhancing additives selected from the group consisting of cetyl pyridinium chloride, distearyl dimethyl ammonium methyl sulfate, potassium tetraphenyl borate, and mixtures thereof.

27. A process according to claim 25 wherein the charge control agent is present in an amount of from about 0.01 to about 15 percent by weight of the toner.

28. A process according to claim 1 wherein the two encapsulated toner compositions of different colors can be triboelectrically charged to within 25 microcoulombs per gram of the same value.

29. A process according to claim 1 wherein the two encapsulated toner compositions of different colors can be triboelectrically charged to within 25 microcoulombs per gram of the same value when the two toners contain identical charge control additives present in substantially the same amounts and when the two toners are in the presence of identical carriers.

30. A process according to claim 1 wherein the two encapsulated toner compositions of different colors can be triboelectrically charged to within 10 microcoulombs per gram of the same value.

31. A process according to claim 1 wherein the interfacial polymerization takes place at a temperature of from about 10° C. to about 30° C.

32. A process according to claim 1 wherein the free radical polymerization of the core monomers is performed at a temperature of from about 50° C. to about 120° C.

33. A process according to claim 1 wherein the free radical polymerization of the core monomers is effected by heating the monomers for from about 8 hours to about 24 hours.

34. A process according to claim 1 wherein the first and second pigments are independently selected from the group consisting of Violet VT-8015, Normandy Magenta RD-2400, Paliogen Violet 5100, Paliogen Violet 5890, Permanent Violet VT-645, Heliogen Green L8730, Argyle Green XP-111-S, Brilliant Green Toner GR0991, Lithol Scarlet D3700, Tolidine Red, Scarlet for Thermoplast NSD PS PA, E. D. Toluidine Red, Lithol Rubine Toner, Lithol Scarlet4440, Bon Red C, Royal Brilliant Red RD-8192, Oracet Pink RF, Paliogen Red 3871K, Paliogen Red 3340, Lithol Fast Scarlet L4300, Heliogen Blue L6900, L7020, Heliogen Blue K6902, K6910, Heliogen Blue D6840, D7080, Sudan Blue OS, Neopen Blue FF4012, PV Fast Blue B2G01, Iragalite Blue BCA, Paliogen Blue 6470, Sudan III, Sudan II, Sudan IV, Sudan Orange 220, Paliogen Orange 3040, Ortho Orange OR2673, Paliogen Yellow 152, 1560, Lithol Fast Yellow 0991K, Paliotol Yellow 1840, Novoperm Yellow FGL, Permanent Yellow YE0305, Lumogen Yellow D0790, Suco-Gelb L1250, Suco-Yellow D1355, Sico Fast Yellow D1355, D1351, Hostaperm Pink E, Fanal Pink D4830, Cinquasia Magenta, Paliogen Black L0084, Pigment Black K801, Regal 330® Carbon Black 5250, Carbon Black 5750 and mixtures thereof.

35. A process according to claim 1 wherein the first and second pigments are present in amounts of from about 5 to about 15 percent by weight of the respective toners.

36. A process according to claim 1 wherein subsequent to free radical polymerization the resulting toners are washed and thereafter dried.

37. A process according to claim 1 wherein the total amount of shell monomer soluble in organic media is from about 4.5 to about 35 percent by weight of the resulting toner composition.

38. A process according to claim 1 wherein the total amount of shell monomer soluble in aqueous media is from about 2.5 to about 15 percent by weight of the resulting toner composition.

39. A process according to claim 1 wherein a strengthening agent is incorporated into the polymeric shells, which strengthening agent is selected from the group consisting of epoxy monomers and epoxy oligomers.

40. A process according to claim 39 wherein the strengthening agent is present in an amount of from about 0.01 to about 30 percent by weight of the polymeric shell.

41. A process according to claim 1 wherein the polymeric shells also include crosslinking monomers selected from the group consisting of triamines, triisocyanates, and triols in an amount of from about 0.01 to about 30 percent by weight of the shell monomers.

42. A process according to claim 1 wherein the two encapsulated toners are subsequently mixed with carrier particles to form developer compositions with similar triboelectric charging characteristics, wherein both toners are mixed with substantially identical carriers.

43. A process according to claim 42 wherein the carrier particles are selected from the group consisting of a ferrite core with a coating comprising a methyl terpolymer which comprises methyl methacrylate in an amount of about 81 percent by weight, styrene in an amount of about 14 percent by weight, and vinyl triethoxysilane in an amount of about 5 percent by weight; an oxidized steel core with a coating comprising a polymer which comprises trifluorochloroethylene in an amount of about 65 percent by weight and vinyl chloride in an amount of about 35 percent by weight, wherein the polymeric coating also contains carbon black particles; a steel core with a coating comprising polyvinylidene fluoride; a steel core with a coating comprising a polymer blend which comprises about 35 percent by weight of polyvinylidene fluoride and about 65 percent by weight of polymethylmethacrylate; and a ferrite core with a coating comprising a methyl terpolymer which comprises methyl methacrylate in an amount of about 81 percent by weight, styrene in an amount of about 14 percent by weight, and vinyl triethoxysilane in an amount of about 5 percent by weight, wherein the polymeric coating also contains carbon black particles.

44. A process according to claim 1 wherein the polymeric shells are selected from the group consisting of polyamides and polyureas.

45. A process according to claim 1 wherein the polymeric shells are polyureas.

* * * * *